US009733054B2

(12) United States Patent
Blagojevic

(10) Patent No.: US 9,733,054 B2
(45) Date of Patent: Aug. 15, 2017

(54) SEALABLE CONTAINER

(71) Applicant: Stevan Blagojevic, Portland, OR (US)

(72) Inventor: Stevan Blagojevic, Portland, OR (US)

( * ) Notice: Subject to any disclaimer, the term of this patent is extended or adjusted under 35 U.S.C. 154(b) by 0 days.

(21) Appl. No.: 14/971,831

(22) Filed: Dec. 16, 2015

(65) Prior Publication Data

US 2016/0167841 A1 Jun. 16, 2016

Related U.S. Application Data

(60) Provisional application No. 62/092,742, filed on Dec. 16, 2014, provisional application No. 62/103,981, filed on Jan. 15, 2015.

(51) Int. Cl.
*F42B 39/26* (2006.01)
*B65D 43/02* (2006.01)

(52) U.S. Cl.
CPC ..... *F42B 39/26* (2013.01); *B65D 43/0216* (2013.01)

(58) Field of Classification Search
CPC . F42B 39/26; B65D 43/0216; B65D 43/0214; B65D 53/00
USPC ..... 206/3, 443
See application file for complete search history.

(56) References Cited

U.S. PATENT DOCUMENTS

| | | | |
|---|---|---|---|
| 1,053,758 | A | 2/1913 | Turnbull |
| 2,727,547 | A | 12/1955 | Moon |
| 2,757,821 | A | 8/1956 | Fitch |
| 2,928,530 | A | 3/1960 | Sauey |
| 3,215,304 | A | 11/1965 | Rohé |
| 3,458,079 | A | 7/1969 | Gasbarra |
| 3,593,873 | A | 7/1971 | Vonk |
| 3,696,957 | A | 10/1972 | Van Baarn |
| 4,194,657 | A | 3/1980 | Thor |
| 4,241,864 | A | 12/1980 | Kessler |

(Continued)

FOREIGN PATENT DOCUMENTS

| | | |
|---|---|---|
| CN | 1796244 A | 7/2006 |
| EP | 1380226 A1 | 1/2004 |

(Continued)

OTHER PUBLICATIONS

Apr. 1, 2016, International Search Report of the International Searching Authority from the U.S. Receiving Office, in PCTUS2015066187, which is the international application to this U.S. application.

(Continued)

*Primary Examiner* — Steven A. Reynolds
(74) *Attorney, Agent, or Firm* — Kolisch Hartwell, P.C.

(57) ABSTRACT

An embodiment of a container may include a cap and a body. The body may include a bottom and body walls extending from the bottom from proximal ends of the body walls to distal ends of the body walls. The body walls may have a channel disposed within the body walls and proximate the distal ends of the body walls. The channel may have a floor, an opening proximate the distal ends of the body walls, an inner wall including an upper inner rim disposed a first distance from the bottom of the body, and an outer wall including an upper outer rim disposed a second distance from the bottom of the body. The second distance may be greater than the first distance relative to the bottom of the body. The channel may be sized to receive a portion of the cap when the container is in a closed position.

20 Claims, 17 Drawing Sheets

(56) References Cited

U.S. PATENT DOCUMENTS

| | | | | |
|---|---|---|---|---|
| 4,334,631 | A | 6/1982 | Ballester | |
| 4,387,805 | A | 6/1983 | Lanius | |
| D276,872 | S * | 12/1984 | Williams | D28/91 |
| 4,491,238 | A * | 1/1985 | Tobolt | B65D 43/0206 220/782 |
| 4,566,588 | A * | 1/1986 | Kataczynski | B65D 71/0096 206/3 |
| 4,757,894 | A * | 7/1988 | Schreckenstein | F42B 39/02 206/1.5 |
| 4,762,222 | A | 8/1988 | Martin | |
| 4,942,991 | A * | 7/1990 | Lyons | F42B 39/02 206/3 |
| 5,125,531 | A * | 6/1992 | Wentz | B65D 25/22 206/811 |
| D329,140 | S | 9/1992 | Maricle | |
| 5,215,207 | A | 6/1993 | Stolzman | |
| 5,231,850 | A | 8/1993 | Morris | |
| D353,043 | S | 12/1994 | Stewart | |
| 5,570,588 | A | 11/1996 | Lowe | |
| 5,680,946 | A | 10/1997 | Cochran | |
| 5,875,918 | A | 3/1999 | Sheffler et al. | |
| 6,019,217 | A | 2/2000 | Melan et al. | |
| 6,250,494 | B1 * | 6/2001 | Diamond | B65D 43/0206 220/782 |
| 6,962,338 | B2 | 11/2005 | Moidu | |
| 8,083,094 | B2 | 12/2011 | Caulfield et al. | |
| 8,448,814 | B2 | 5/2013 | Yamamoto et al. | |
| 9,090,385 | B2 | 7/2015 | Blagojevic | |
| 2003/0146220 | A1 | 8/2003 | Kaura | |
| 2004/0173613 | A1 | 9/2004 | Schroeder et al. | |
| 2005/0116003 | A1 | 6/2005 | Butler et al. | |
| 2010/0193533 | A1 | 8/2010 | Roesler | |
| 2011/0174639 | A1 | 7/2011 | Sibley | |
| 2011/0233076 | A1 | 9/2011 | Potterfield et al. | |
| 2014/0008377 | A1 | 1/2014 | Findleton | |
| 2015/0021216 | A1 | 1/2015 | Blagojevic | |
| 2015/0284151 | A1 | 10/2015 | Blagojevic | |

FOREIGN PATENT DOCUMENTS

| | | | |
|---|---|---|---|
| GB | 521263 | A | 5/1940 |
| GB | 671086 | A | 4/1952 |
| JP | 61-64813 | U | 5/1986 |
| WO | 2006070965 | A1 | 7/2006 |

OTHER PUBLICATIONS

Apr. 1, 2016, Written Opinion of the International Searching Authority from the U.S. Receiving Office, in PCTUS2015066187, which is the international application to this U.S. application.

Cabela's, photographs of ammunition box (big box), Applicant indicates to consider it as if prior art but date is unknown, circa before Jul. 18, 2013.

Cabela's, photographs of ammunition box (little box), Applicant indicates to consider it as if prior art but date is unknown, circa before Jul. 18, 2013.

Unknown author, photographs of storage box with slats (purple box), Applicant indicates to consider it as if prior art but date is unknown, circa before Jul. 18, 2013.

Unknown author, photographs of closable capsule (1 of 2), Applicant indicates to consider it as if prior art but date is unknown, circa before Jul. 18, 2013.

Unknown author, photographs of closable capsule (2 of 2), Applicant indicates to consider it as if prior art but date is unknown, circa before Jul. 18, 2013.

Nov. 3, 2014, First Action Interview Pilot Program Pre-Interview Communication from the U.S. Patent and Trademark Office, in U.S. Appl. No. 14/337,119, which is another application of applicant Stevan Blagojevic.

Nov. 12, 2014, International Search Report of the International Searching Authority from the U.S. Receiving Office, in PCT Patent Application PCT/US2014/047488, which is an international application of applicant Stevan Blagojevic.

Nov. 12, 2014, Written Opinion of the International Searching Authority from the U.S. Receiving Office, in PCT Patent Application PCT/US2014/047488, which is an international application of applicant Stevan Blagojevic.

Feb. 2, 2015, Office Action from the U.S. Patent and Trademark Office, in U.S. Appl. No. 14/337,119, which is another application of applicant Stevan Blagojevic.

May 1, 2015, Office Action from the U.S. Patent and Trademark Office, in U.S. Appl. No. 14/337,119, which is another application of applicant Stevan Blagojevic.

Jan. 28, 2016, International Preliminary Report on Patentability from the International Bureau of WIPO, in PCT Patent Application PCT/US2014/047488, which is an international application of applicant Stevan Blagojevic.

Jun. 29, 2016, First Action Interview Pilot Program Pre-Interview Communication from the U.S. Patent and Trademark Office in U.S. Appl. No. 14/745,149, which is another application of Applicant Stevan Blagojevic.

Oct. 26, 2016, First Action Interview Office action from the U.S. Patent and Trademark Office in U.S. Appl. No. 14/745,149, which is another application of Applicant Stevan Blagojevic.

Feb. 8, 2017, First Office Action from the State Intellectual Property Office of China, in Chinese Application No. 201480040942.0, which is a foreign application of Applicant Stevan Blagojevic.

Apr. 5, 2017, Extended European Search Report from The European Patent Office, in EP Application No. 14827077.0, which is a foreign application of Applicant Stevan Blagojevic.

* cited by examiner

SEALABLE CONTAINER

CROSS-REFERENCE TO RELATED APPLICATIONS

This application claims priority from U.S. Provisional Patent Application Ser. Nos. 62/092,742, filed Dec. 16, 2014, and 62/103,981, filed Jan. 15, 2015, all of which are hereby incorporated by reference.

This application further incorporates by reference into the present disclosure for all purposes: U.S. Patent Publication No. 2015/0021216 and U.S. Pat. No. 9,090,385.

INTRODUCTION

The present disclosure relates to systems and methods related to sealable containers for varying uses. There are many scenarios when a person would wish to keep an item or items protected, organized, dry, and portable. Outdoor and work activities in wet or dirty environments such as camping, fishing, or hunting, would present many opportunities where a container that could achieve such features would be useful, for example to hold ammunition or fire-starting materials. Such a container could also be useful in daily life, for example, to hold make-up, art supplies, or cigarettes and matches.

SUMMARY

Systems and methods of the present disclosure may be related to a sealable container. An embodiment of a container of the present disclosure may include a cap and a body. The cap may include a top portion, cap walls that extend from the top portion and form an outer perimeter, and a protruding end, extending from the cap walls in an opposite direction from the top portion, the protruding end forming an inner perimeter that is sized smaller than the outer perimeter. The body may include a bottom portion, body walls extending from the bottom portion from proximal ends of the body walls to distal outermost ends of the body walls, the body walls forming a cavity on an inner side and a body perimeter on an outer side, the body perimeter having a substantially consistent size between the proximal and distal outermost ends and being sized substantially the same as the outer perimeter. The body may also include an upper outer rim formed around outermost edges of the distal outermost ends, and an upper inner rim formed around inner edges of the distal outermost ends. The upper outer and inner rims may be disposed around the entire distal outermost ends and have a channel between the upper outer and inner rims, the channel being sized to receive the protruding end in a friction seal when the container is in a closed position.

An embodiment of a container of the present disclosure may include a cap and a body. The cap may have a ridge extending from a bottom edge of the cap. The ridge may have a first set of sealers disposed circumferentially around the ridge on an exterior side of the ridge and a second set of sealers disposed circumferentially around the ridge on an interior side of the ridge. The body may have a channel proximate an upper outer rim of the body and the channel may have a set of guides disposed at an opening of the channel. The container may be adapted to have a closed position where the cap is placed on the body such that the ridge is inserted into the channel guided by the guides and the sealers create a friction seal with interior sides of the channel.

An embodiment of a container of the present disclosure may include a cap and a body. The cap may include a top portion, cap walls that extend from the top portion and form an outer perimeter, and a protruding end, extending from the cap walls in an opposite direction from the top portion, the protruding end forming an inner perimeter that is sized smaller than the outer perimeter. The protruding end may have one or more first friction sealer(s) disposed on a first side of the protruding end and one or more second friction sealer(s) disposed on a second side of the protruding end that is opposite the first side. The body may include a bottom portion, body walls extending from the bottom portion from proximal ends of the body walls to distal outermost ends of the body walls, the body walls forming a cavity on an inner side and a body perimeter on an outer side. The body perimeter may have a substantially consistent size between the proximal and distal outermost ends and may be sized substantially the same as the outer perimeter. The body may also include an upper outer rim formed around outermost edges of the distal outermost ends and having a first guide adapted to guide the protruding end from an unclosed position to a closed position, and an upper inner rim formed around innermost edges of the distal outermost ends having a second guide adapted to guide the protruding end from the unclosed position to the closed position. The upper outer and inner rims may be disposed around the entire distal outermost ends and have a channel between the upper outer and inner rims. The channel may be sized to receive the protruding end in a friction seal when the container is in the closed position. In the closed position, the cap and the body may form a flush fit and the cavity may be waterproof and airtight.

An embodiment of a container may include a cap and a body. The body may include a bottom and body walls extending from the bottom from proximal ends of the body walls to distal ends of the body walls. The body walls may have a channel disposed within the body walls and proximate the distal ends of the body walls. The channel may have a floor, an opening proximate the distal ends of the body walls, an inner wall including an upper inner rim disposed a first distance from the bottom of the body, and an outer wall including an upper outer rim disposed a second distance from the bottom of the body. The second distance may be greater than the first distance relative to the bottom of the body. The channel may be sized to receive a portion of the cap when the container is in a closed position.

Features, functions, and advantages may be achieved independently in various embodiments of the present disclosure, or may be combined in yet other embodiments, further details of which can be seen with reference to the following description and drawings.

BRIEF DESCRIPTION

Advantages of the present disclosure will be more readily understood after considering the drawings and the Detailed Description.

DETAILED DESCRIPTION

Overview

The drawings illustrate embodiments and schematic concepts for one or more containers according to the present disclosure. The purpose of these drawings is to aid in explaining the principles of the present disclosure. Thus, the drawings should not be considered as limiting the scope of the present disclosure to the embodiments and schematic concepts shown therein. Other embodiments of containers may be created which follow the principles of the present disclosure as taught herein, and these other embodiments are intended to be included within the scope of the present disclosure.

EXAMPLES

Components, and Alternatives

The following sections describe selected aspects of exemplary containers. The examples in these sections are intended for illustration and should not be interpreted as limiting the entire scope of the present disclosure. Each section may include one or more distinct inventions, and/or contextual or related information, function, and/or structure.

Example 1

Figure 1:
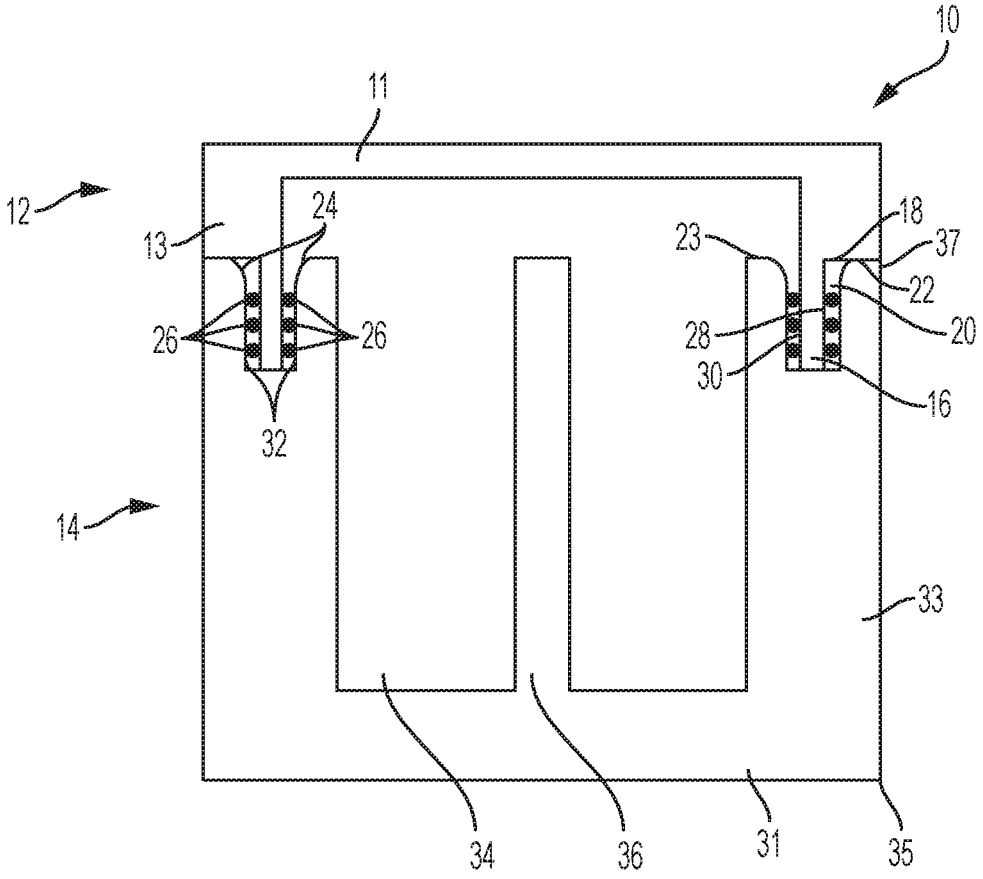
FIG. 1 shows a schematic illustration of an embodiment of a container according to the present disclosure.

This example describes an illustrative container, see FIG. 1.

A container 10 of the present disclosure may include a cap 12 and a body 14. Cap 12 may have a top portion 11 and cap walls 13 that extend from top portion 11. These cap walls may form an outer perimeter (see, for example, FIG. 2). Cap 12 may have a ridge or protruding end 16 extending from proximate a bottom 18 of cap walls 13 in an opposite direction from top portion 11. Protruding end 16 may form an inner perimeter that is sized smaller than the outer perimeter (see, for example, FIGS. 2 and 11).

Body 14 may have a bottom portion 31 and body walls 33 extending from bottom portion 31 from proximal ends 35 to distal outermost ends 37. Body walls 33 may form a cavity on an inner side and a body perimeter on an outer side (see, for example, FIGS. 2 and 11). The body perimeter may have a substantially consistent size and may be substantially the same size as the outer perimeter of cap 12. By "substantially" it is meant within the tolerances of whatever manufacturing technique is used.

Body 14 may have an upper outer rim 22 formed around outermost edges of distal outermost ends 37. Body 14 may have an upper inner rim 23 formed around inner edges of distal outermost ends 37. Upper outer rim 22 and upper inner rim 23 may be disposed around the entire distal outermost ends 37 and may have a channel 20 between upper outer rim 22 and upper inner rim 23.

When container 10 is in a closed position the cap 12 may be placed on the body 14 so that ridge 16 is inserted into channel 20. There may be a first guide 24 proximate upper outer rim 22 to guide ridge 16 into channel 20. There may be a second guide 24 proximate upper inner rim 23 to guide ridge 16 into channel 20. Ridge 16 may have one or more sealers 26 that are disposed circumferentially around ridge 16 on an exterior side 28 of the ridge 16 and/or on an interior side 30 of the ridge 16. The sealers 26 may engage the sides 32 of channel 20 when cap 12 is in the closed position with body 14, creating a friction fit or seal, thus preventing water or air from entering container 10.

Container 10 may have one or more distinct internal compartments 34 separated by zero or more dividers 36.

FIG. 1 is a schematic illustration and is not drawn to scale. Certain elements such as the outer perimeter of the cap walls, the inner perimeter of ridge 16, and the body perimeter formed by body walls 33 are seen best in other FIGS., for example FIGS. 2 and 11.

Container 10 may be made from any suitable material, including plastic. The plastic may be strong, durable, and consumer-safe. Container 10 may be constructed with any process appropriate to the given material. In the case that container 10 is made of plastic, container 10 may be constructed using an injection molding process, among others.

Container 10 may serve a variety of purposes, determined by the user. For example, the user may wish container 10 to hold various tobacco products or rounds of ammunition. The size and exterior dimensions of container 10 and the configuration of the internal compartments 34 may be determined by the intended use of container 10. For example, a container 10 intended to hold rounds of ammunition may be taller than a container 10 intended to hold cigarettes. Further, internal compartments 34 configured to hold a cigarette may not securely hold a round of ammunition. Bottom portion 31 may be substantially flat, allowing container 10 to stand unsupported.

Example 2

This example describes another illustrative container, see FIGS. 2-10.

Figure 2:
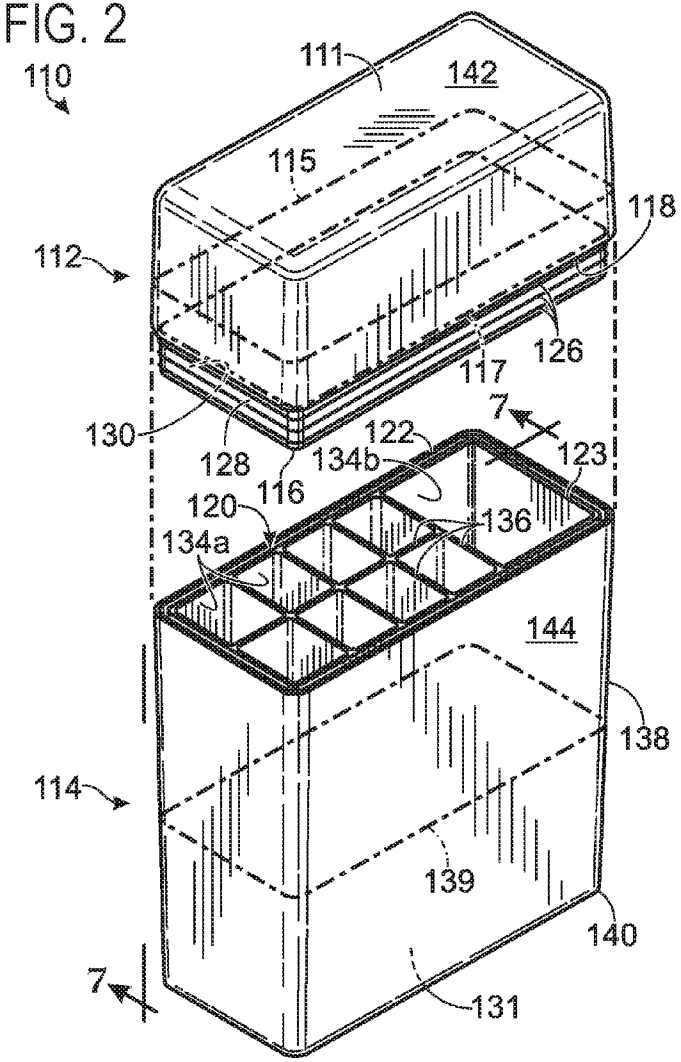
FIG. 2 shows a perspective view of an embodiment of a container with a cap and a body unattached.

FIG. 2 shows a first embodiment of container 110 in an unattached position, that is, where a cap 112 and a body 114 are separate from each other. Cap 112 may have a top portion 111 and an outer perimeter 115. A ridge or protruding end 116 may extend from a bottom edge 118 of cap 112 and form an inner perimeter 117. An exterior side 128 of ridge 116 may be lined with sealers 126. In this embodiment the sealers 126 are a set of three ribs 126 that protrude from the exterior side 128 of ridge 116. An interior side 130 of ridge 116 may be lined with sealers 126. In this embodiment the sealers 126 are a set of three ribs 126 that protrude from the interior side 130 of ridge 116. The interior side cannot be seen in FIG. 2 but can be seen in FIG. 4.

Body 114 may have a bottom portion 131 and a body perimeter 139. Body perimeter 139 may be substantially the same size at various points along the body. Body perimeter 139 may be substantially the same size as outer perimeter 115 of cap 112. Channel 120 may be disposed between an upper outer rim 122 and an upper inner rim 123 of body 114. Some or all exterior edges 138 and some or all exterior corners 140 of container 110 may be rounded. An exterior surface 142 of cap 112 and an exterior surface 144 of body 114 may be textured to improve a person's ability to grip container 110.

In this embodiment some of a set of internal compartments 134*a* may be configured to hold individual cigarettes, while another internal compartment 134*b* may be configured to hold matches or other igniting devices. The internal compartments 134*a* and 134*b* may be separated by dividers 136.

Figure 3:
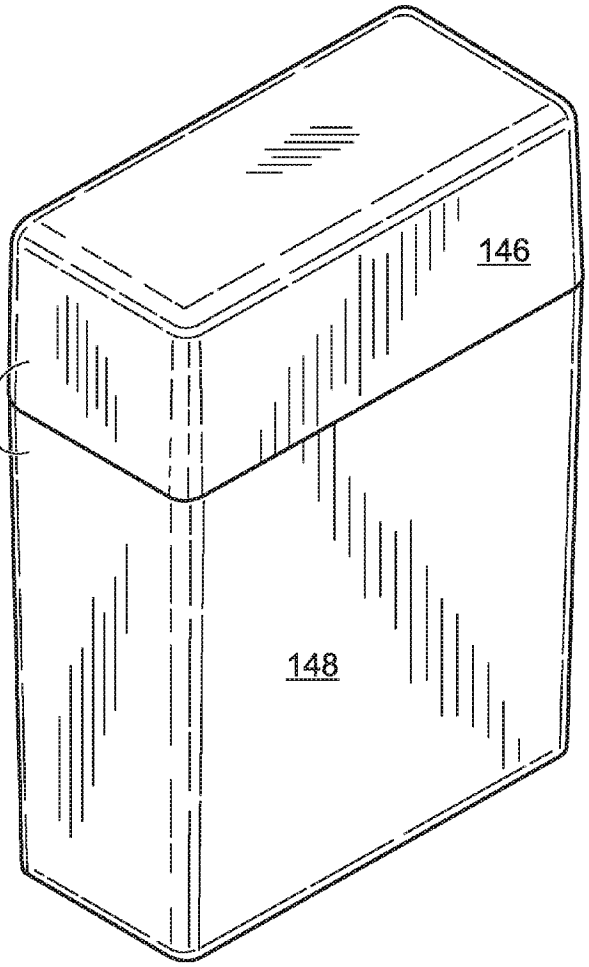
FIG. 3 shows a perspective view of the embodiment of FIG. 2 of the container with the cap and body attached in a closed position

FIG. 3 shows an embodiment of container 110 in a closed position, that is, where cap 112 and body 114 are connected. Cap 112 may fit flush with body 114. "Flush" means that an exterior side 146 of cap 112 and an exterior side 148 of body 114 form or substantially form one surface generally indicated at 150 when cap 112 is attached to body 114. Surface 150 may have no protrusions or other features where cap 112 and body 114 meet. Cap 112 and body 114 may fit flush on all four sides of container 110.

The features of container 110 may prevent container 110 from inadvertently opening while inside a larger container or in a person's pocket. When this embodiment of container 110 is in a closed position the external dimensions may be such that the width is about 1.54 inches, the length is about 2.6 inches, and the height is about 3.65 inches, subject to manufacturing tolerances. Other dimensions may be appropriate depending on the number and the size of the cigarettes container 110 is intended to hold.

Figure 4:
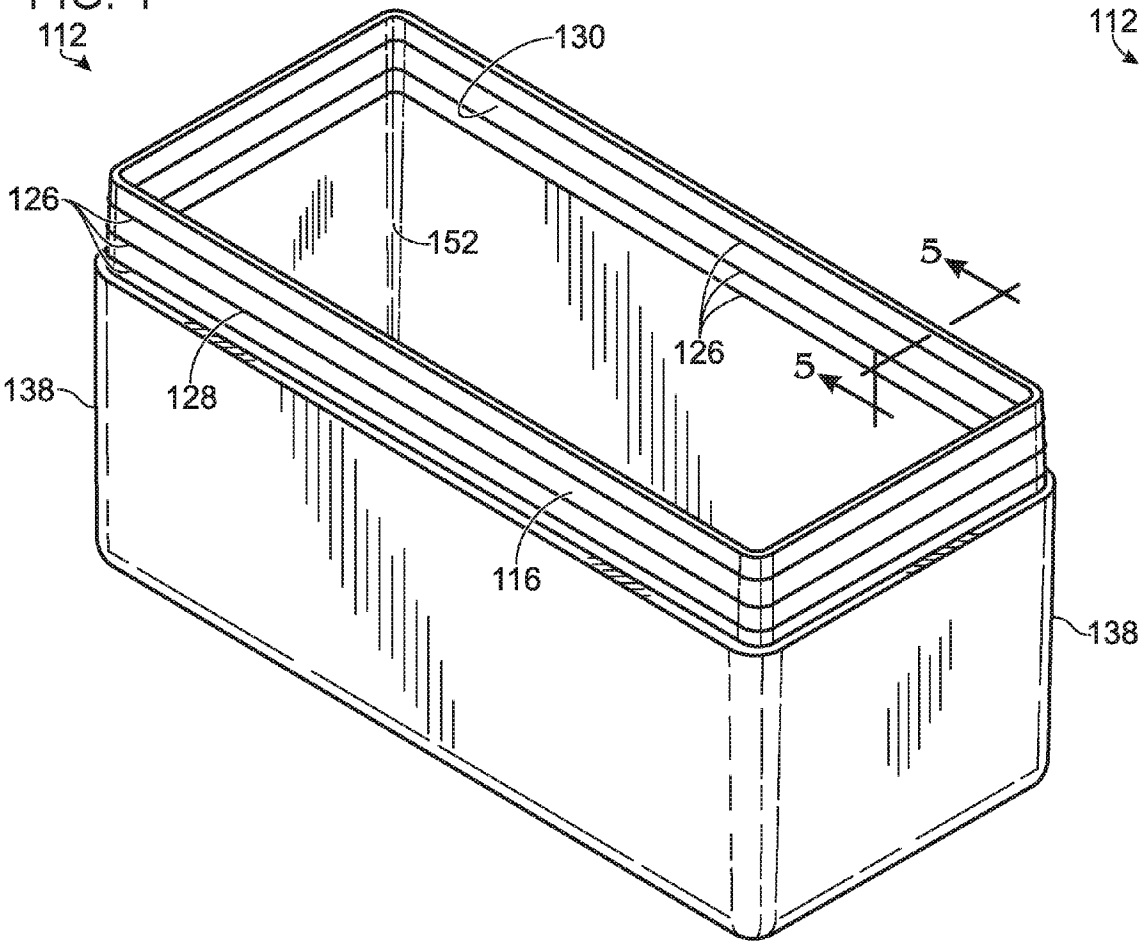
FIG. 4 shows a perspective view of the embodiment of the cap of FIG. 2.

FIG. 4 shows an embodiment of cap 112, having a set of three ribs 126 on the exterior side 128 of ridge 116 and a set of three ribs 126 on the interior side 130 of ridge 116. In addition to exterior edges 138 being rounded, all interior edges 152 may be rounded as well.

Figure 5:
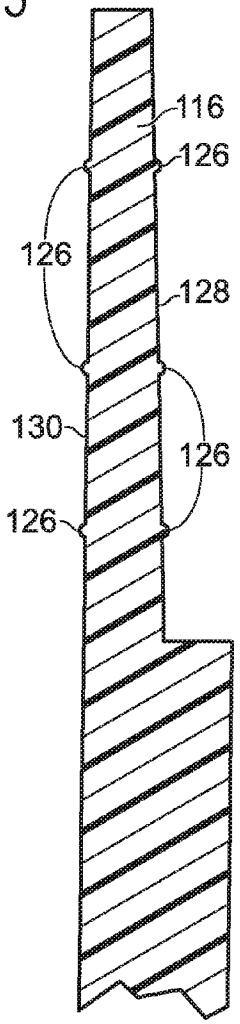
FIG. 5 shows a cross-sectional view, taken along plane 5-5 in FIG. 4, of a ridge extending from a bottom edge of the embodiment of the cap of FIG. 2.

FIG. 5 is a cross-sectional view, taken along plane 5-5 in FIG. 4, of the embodiment of ridge 116 on cap 112. On both the exterior side 128 and the interior side 130 of ridge 116 the ribs 126 may protrude from the surface of ridge 116.

Figure 6:
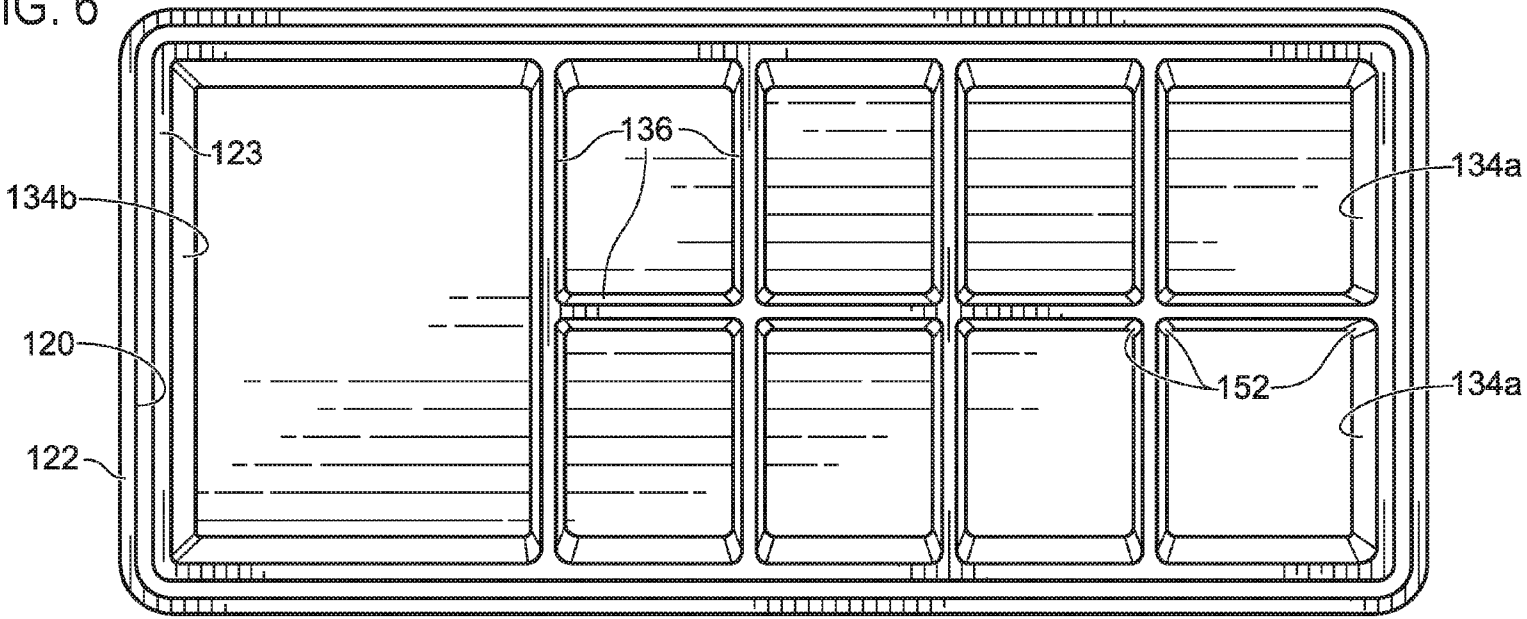
FIG. 6 shows a top view of the embodiment of the body of FIG. 2.

FIG. 6 shows a top down view of the embodiment of body 114 from FIG. 2. Channel 120 may be located between upper outer rim 122 and upper inner rim 123. The internal compartments 134*a* and 134*b* may be separated by dividers 136. The interior edges 152 where the dividers 136 meet each other or where the dividers 136 meet the interior walls of body 114 may be rounded.

Figure 7:
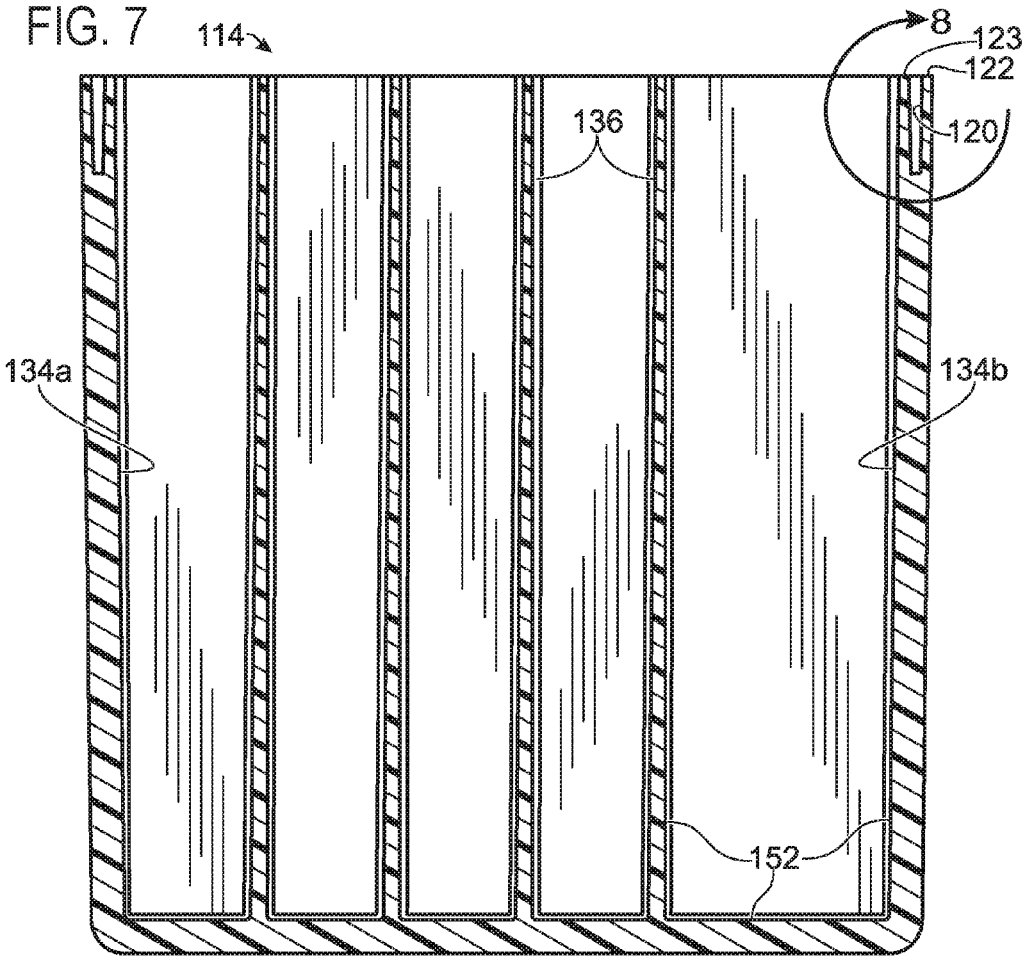
FIG. 7 shows a cross-sectional view, taken along plane 7-7 in FIG. 2, of the embodiment of the body.

FIG. 7 is a cross-sectional view, taken along plane 7-7 in FIG. 2, of an embodiment of body 114 of container 110. Channel 120 may be proximate upper outer rim 122 and upper inner rim 123. The dividers 136 may separate the internal space of body 114 into one or more compartments 134*a* sized to accept individual cigarettes, and/or into one or more compartments 134*b* sized to accept matches or other materials that could ignite a cigarette. The interior edges 152 where the dividers 136 meet each other, the walls, or the floor of body 114 may be rounded. This rounding of interior edges may serve to help protect the contents of internal compartments 134, and facilitate cleaning of internal compartments 134.

Figure 9:
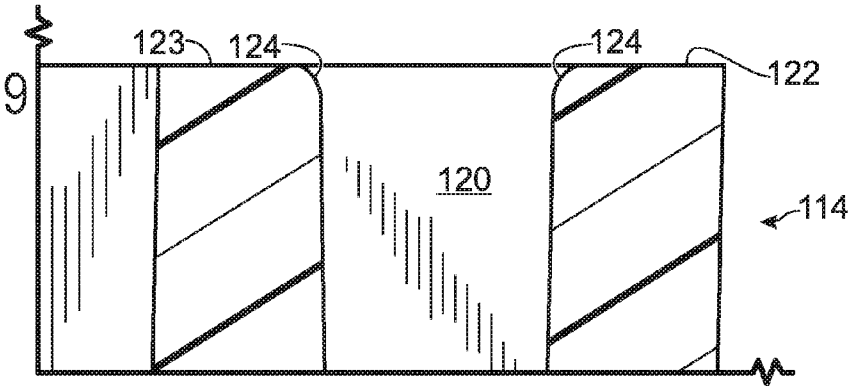
FIG. 9 shows a detailed view, taken at 9 in FIG. 8, of a cross-section of an embodiment of the body, showing a set of guides.
Figure 8:
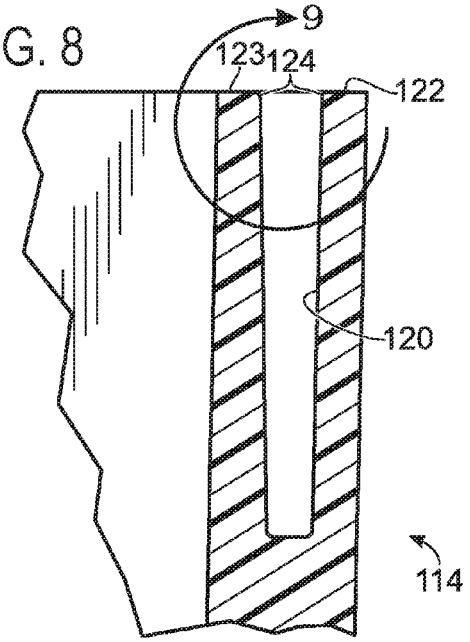
FIG. 8 shows a detailed view, taken at 8 in FIG. 7, of a cross-section of the embodiment of the body of the container, showing a channel set into a top edge of the body of the container.

FIG. 8 is a detailed view, taken at 8 in FIG. 7, of the upper outer rim 122 and upper inner rim 123 of the embodiment of body 114 of container 110. Channel 120 may be proximate upper outer rim 122 and upper inner rim 123. A first guide 124 may be proximate where upper outer rim 122 meets channel 120. A second guide 124 may be proximate where upper inner rim 123 meets channel 120. As best seen in FIG. 9 the guides 124 may be rounded edges. Guides 124 may help ridge 116 (not shown) slide into channel 120 in order to close container 110.

FIG. 9 is an even more detailed view, taken at 9 in FIG. 8, of upper outer rim 122, upper inner rim 123, channel 120 and guides 124.

Figure 10:
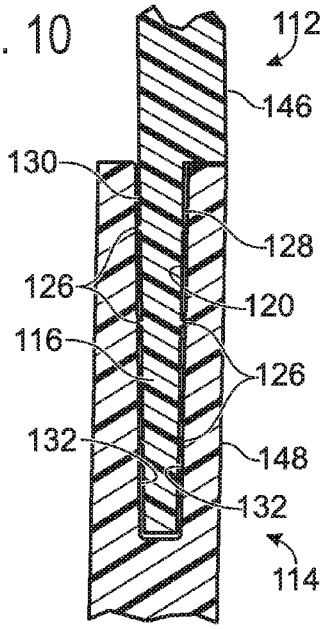
FIG. 10 shows a cross-sectional view of the embodiment of the container in the closed position, showing the ridge on the cap inserted into the channel in the body.

FIG. 10 is a detailed cross-sectional view of the embodiment of container 110 when the ridge 116 of cap 112 has been inserted into the channel 120 of body 114. The ribs 126 that extend from the exterior side 128 of ridge 116 may be in physical contact with the sides 132 of channel 120. The ribs 126 that extend from the interior side 130 of ridge 116 may be in physical contact with the sides 132 of channel 120. This contact may create a friction fit or seal. This contact may create an air-tight or a water-tight seal that would prevent water or air from entering container 110. The exterior side 146 of cap 112 may fit flush with the exterior side 148 of body 114.

Example 3

Figure 13:
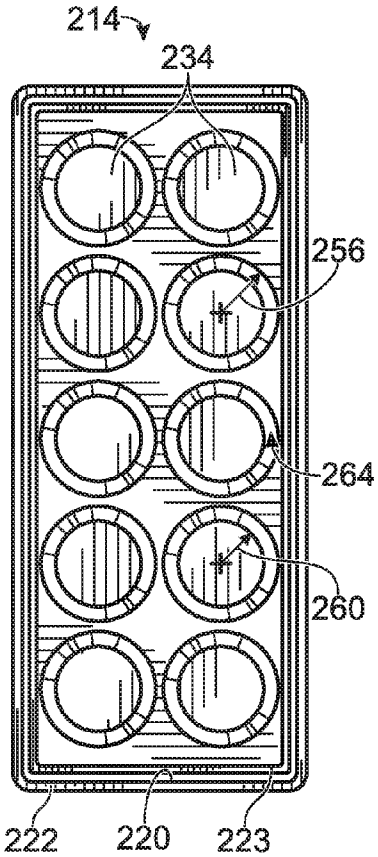
FIG. 13 shows a top view of the embodiment of the body of FIG. 11.
Figure 12:
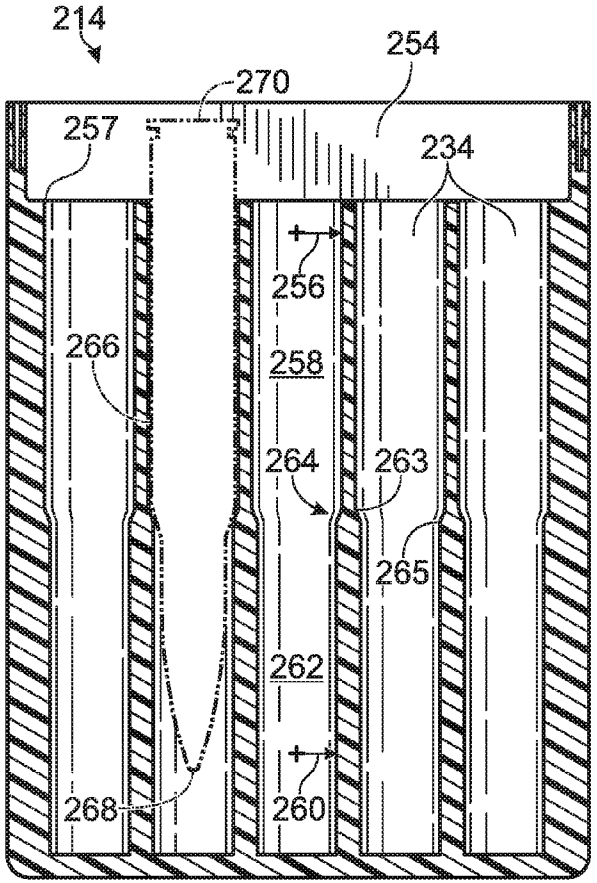
FIG. 12 shows a cross-sectional view, taken along plane 12-12 in FIG. 11, of the embodiment of the body of FIG. 11.
Figure 11:
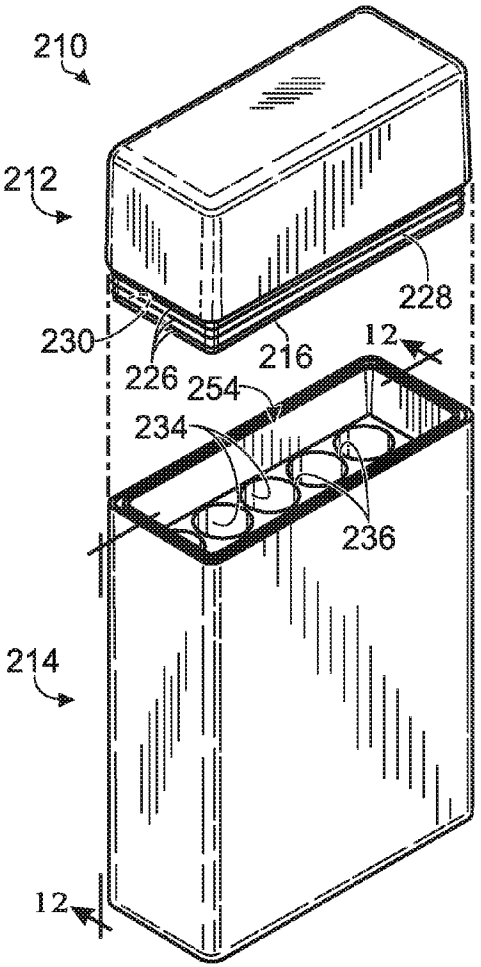
FIG. 11 shows a perspective view of another embodiment of a container with a cap and a body unattached.

This example describes another illustrative container, see FIGS. 11-13. FIG. 11 shows another embodiment of a container 210 in an unattached position, that is, where a cap 212 and a body 214 are not connected. Most of the features of this embodiment may be the same or similar to the embodiment described above and shown in FIGS. 1 through 9. For example, cap 212 may have a first set of sealers 226 on an exterior side 228 of a ridge 216 and a second set of sealers 226 on an interior side 230 of ridge 216 (not visible in this FIG., see FIG. 4 for a view of both sets of sealers 226). The primary differences between the two embodiments are the configuration of a set of internal compartments 234 and a set of dividers 236 that separate them, and the exterior dimensions of container 210. In this embodiment the internal compartments 234 may be configured to hold rounds of ammunition or bullets. As can be seen in FIG. 11 the internal compartments 234 may have a generally cylindrical shape. Further, there may be an open space 254 in body 214 above the internal compartments 234. One purpose of this space will be made clear with FIG. 12. When this embodiment of container 210 is in a closed position the external dimensions may be such that the width is about 1.26 inches, the length is about 3.0 inches, and the height is about 5.0 inches, subject to manufacturing tolerances. Other dimensions may be appropriate depending on the number and the size of the rounds of ammunition container 210 is intended to hold.

FIG. 12 is a cross-sectional view, taken at plane 12-12 in FIG. 11, of body 214. In this embodiment the internal compartments 234 are generally cylindrical. The internal compartments may have a radius 256 of an upper portion 258 that is slightly larger than a radius 260 of a lower portion 262 and a region 264 where the radius changes. An edge 263 between upper portion 258 and region 264 may be rounded. Another edge 265 between region 264 and lower portion 262 may also be rounded. A top edge 257 of internal compartment 234 where upper portion 258 meets open space 254 may also be rounded. The dashed line in FIG. 12 indicates a round of ammunition or bullet 266 as it would sit in container 210. All dimensions of an internal compartment 234, including the depth, radius 256 of the upper portion 258, radius 260 of the lower portion 262, and location of the region 264 where the radius changes may be chosen so that a round of ammunition would sit securely as indicated, namely that an end 268 of the round 266 does not rest on the bottom of container 210 and so that an upper rim 270 of the round 266 protrudes up into the open space 254 above the internal compartments 234. This may facilitate removal of round 266 from container 210. Other configurations of the internal compartments 234 to hold the bullet in other desired positions can also be utilized, as desired.

FIG. 13 is a top down view of an embodiment of the body 214 of container 210. Channel 220 may be proximate an upper outer rim 222 and an upper inner rim 223. In this embodiment the internal compartments 234 may be configured to hold rounds of ammunition. The internal compartments 234 may be generally cylindrical with a larger radius 256 towards the top of the compartment, a region 264 where the radius decreases, and with a smaller radius 260 towards the bottom of the compartment.

Example 4

Figure 14:
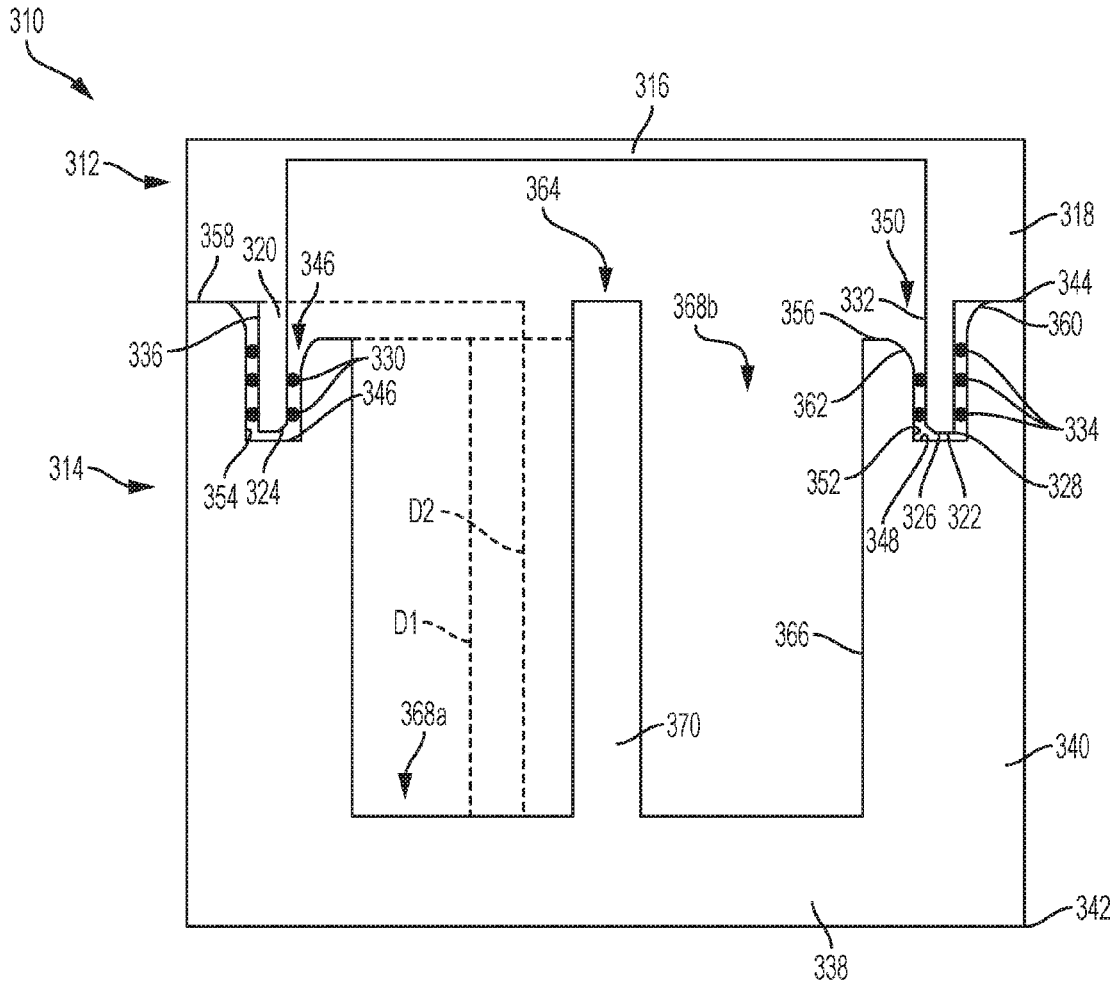
FIG. 14 shows a schematic illustration of another embodiment of a container according to the present disclosure.

This example describes another illustrative container, see FIG. 14.

FIG. 14 shows a schematic cross-section of an embodiment of a container 310. Container 310 may be similar to any of the other exemplary containers described herein. Contain 310 may include a cap 312 and a body 314.

Cap 312 may include a top 316, cap walls 318, and a protruding end 320. The cap walls may extend from the top and the protruding end may extend from the cap walls in an opposite direction from the top. The protruding end 320 may have a remote end 322 that is distal from the cap walls 318. The protruding end may have a cap inside chamfer 324 proximate an inner lip 326 of the remote end 322. Cap inside chamfer 324 may be an angled portion and/or a rounded edge and/or a beveled edge and/or a radiused edge. Cap inside chamfer 324 may also facilitate the joining of cap 312 with body 314 when placing container 310 into a closed position. In addition to cap inside chamfer 324, the protruding end may include a cap outside chamfer proximate an outer lip 328 of the remote end. Cap 312 may include one or both of the cap inside chamfer 324 and the cap outside chamfer.

Cap 312 may include one or more first friction sealer(s) 330 disposed on a first side 332 of the protruding end 320. The cap may include one or more second friction sealer(s) 334 disposed on a second side 336 of the protruding end. The second side 336 may be opposite the first side 332 on the protruding end. Cap inside chamfer 324 may be disposed between the first friction sealer(s) 330 and the remote end 322 of the protruding end 320.

Body 314 may include a bottom 338 and body walls 340 extending from the bottom from proximal ends 342 of the body walls to distal ends 344 of the body walls. The body walls may have a channel 346 disposed within the body walls and proximate the distal ends of the body walls.

Channel 346 may have a floor 348, an opening 350 proximate the distal ends 344 of the body walls 340, an inner wall 352, and an outer wall 354. The inner wall 352 may include an upper inner rim 356 disposed a first distance D1 from the bottom 338 of the body. The outer wall 354 may include an upper outer rim 358 disposed a second distance D2 from the bottom of the body. The second distance D2 may be greater than the first distance D1, relative to the bottom of the body.

Either of the inner wall 352 and the outer wall 354 of the channel may extend in a single continuous arc between the floor 348 of the channel and the opening 350 of the channel. That is, either of the inner and outer walls may extend smoothly from the floor of the channel to the opening of the channel without any discontinuous joints, protrusions, indentations, or other disruptions.

Body 314 may include a first guide 360 proximate the upper outer rim 358 and may include a second guide 362 proximate the upper inner rim 356. Either of the first guide and/or the second guide may be a rounded edge, and/or a radiused edge, and/or a beveled edge, and/or a chamfered edge.

Channel 346 may be sized to receive a portion of the cap 312 when the container 310 is in a closed position, the closed position depicted in FIG. 14. The protruding end 320 may be the portion of the cap received within the channel. Receiving the protruding end into the channel may be facilitated by any of the cap inside chamfer 324, the first guide 360, or the second guide 362.

When container 310 is in the closed position the one or more first friction sealer(s) 330 and the one or more second friction sealers 334 may form a friction seal with the inner wall 352 and the outer wall 354, respectively, within the channel. The one or more first friction sealer(s) and second friction sealer(s) may be flexible ribs that may flex to form the friction seal. The friction seal may be such that a frictional force between the cap and the body may be the only force holding the cap in the closed position with the body. For example, if container 310 is turned upside down while in the closed position, the cap and body may remain in the closed position strictly as a result of frictional forces between the cap and body. Either of the one or more first friction sealer(s) 330 or the one or more second friction sealer(s) 334 may make contact with, but not protrude through, respective surface areas of the inner wall 352 and the outer wall 354.

The body walls 340 may form a cavity 364 on an inner side 366. Cavity 364 may have one or more compartments, for example compartments 368*a* and 368*b*. The compartments may be separated by one or more dividers 370. The compartments may be configured to hold specific items, such as tobacco products, lighting material, rounds of ammunition, or any other appropriate item.

Example 5

Figure 15:
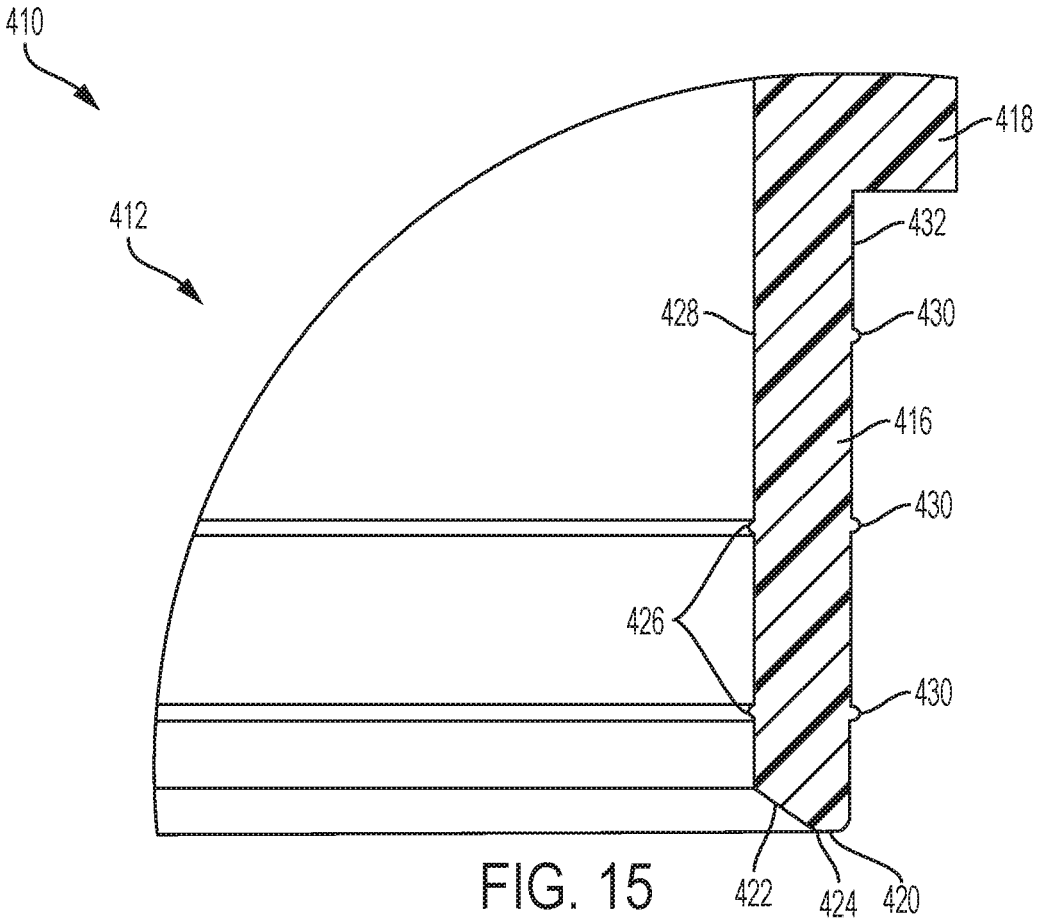
FIG. 15 shows a cross-sectional view of a protruding end of a cap of another embodiment of a container.
Figure 16:
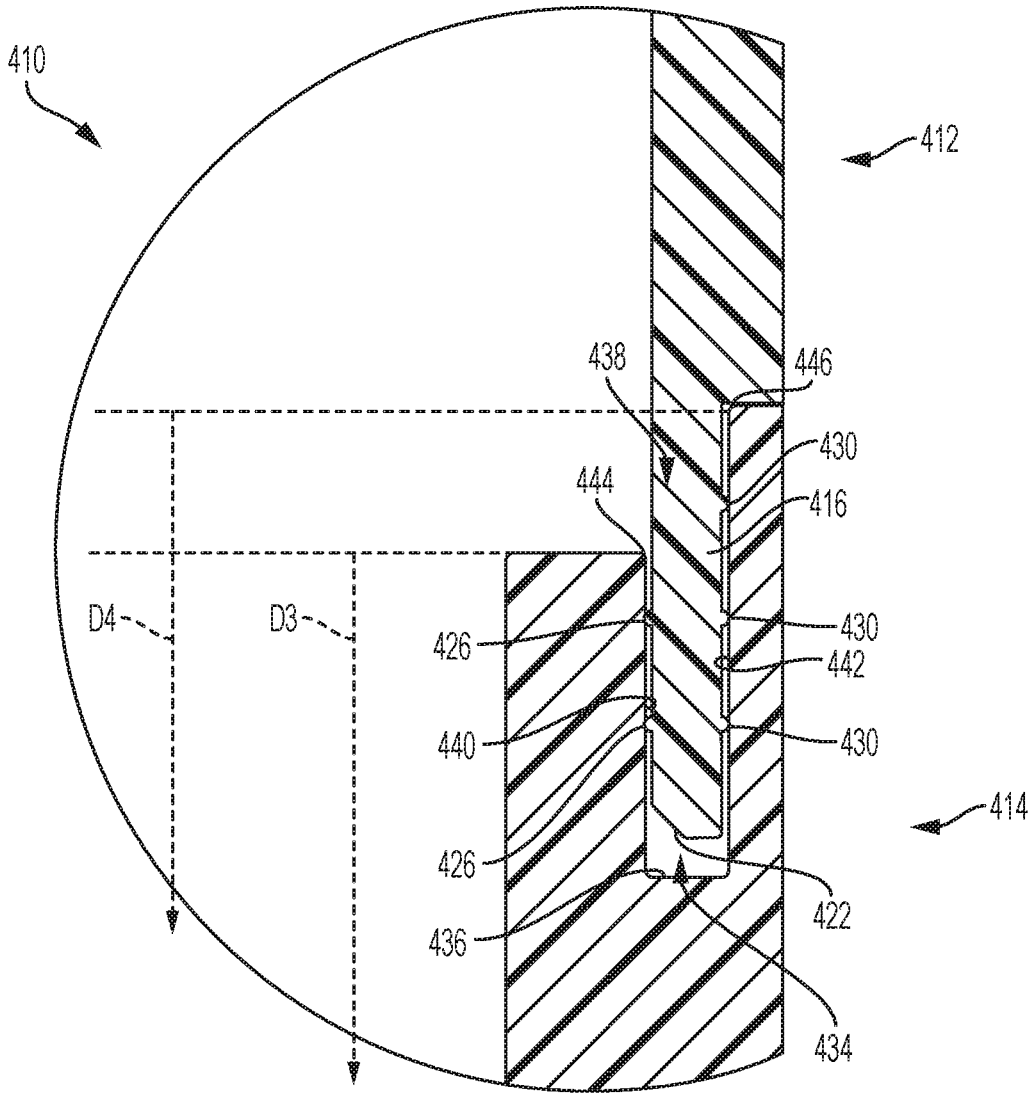
FIG. 16 shows a cross-sectional view of an embodiment of the container of FIG. 15 in the closed position, showing the protruding end of the cap received in the channel of the body.

This example describes another illustrative embodiment of a container, see FIGS. 15-16.

FIG. 15 shows a cross-sectional view of an embodiment of a container, generally indicated at 410. In particular, FIG. 15 shows a detailed cross-sectional view of a cap 412 of container 410. Container 410 may include a body 414, a portion of which may best be seen in FIG. 16. Cap 412 is an embodiment of cap 312 and body 414 is an embodiment of body 314 as described in Example 4.

The detailed view of FIG. 15 shows a protruding end 416 extending from a cap wall 418 to a remote end 420 of the protruding end. The protruding end may have a cap inside chamfer 422 proximate an inner lip 424 of the remote end. Cap inside chamfer 422 may be a sloping surface proximate the remote end and may facilitate the reception of protruding end 416 within a channel of the body of container 410. Cap inside chamfer 422 may be an angled portion and/or a rounded edge and/or a beveled edge and/or a radiused edge.

Cap 412 may include one or more first friction sealer(s) 426 disposed on a first side 428 of the protruding end 416. The one or more first friction sealer(s) may be flexible ribs configured to flex to form a friction seal with the channel of the body when container 410 is in a closed position. The one or more first friction sealer(s) may make contact with, but not protrude through, a surface area of an inner wall of the channel of the body when the container is in the closed position. Cap inside chamfer 422 may be disposed between the one or more first friction sealer(s) and the remote end 420 of the protruding end.

Cap 412 may include one or more second friction sealer(s) 430 disposed on a second side 432 of the protruding end. The one or more second friction sealer(s) may be flexible ribs configured to flex to form a friction seal with the channel of the body when container 410 is in the closed position. The one or more second friction sealer(s) may make contact with, but not protrude through, a surface area of an inner wall of the channel of the body when the container is in the closed position.

FIG. 16 shows a detailed cross-sectional view of container 410 in the closed position, showing the protruding end 416 of the cap 412 received in a channel 434 of the body 414.

Channel 434 is an embodiment of channel 346 described in Example 4. Channel 434 may have a floor 436, an opening 438, an inner wall 440, and an outer wall 442. The inner wall 440 may include an upper inner rim 444 which may be disposed a first distance D3 from a bottom of the body. The bottom of the body may be out of view in FIG. 16. The outer wall 442 may include an upper outer rim 446 which may be disposed a second distance D4 from the bottom of the body. The second distance D4 may be greater than the first distance D3 relative to the bottom of the body. Disposing the upper inner rim 444 closer to the bottom of the body than the upper outer rim 446 may facilitate placing the cap 412 into the closed position with the body 414.

A difference between the second distance D4 and the first distance D3 may be zero inches. In some embodiments, the difference may be greater than zero inches. In some embodiments the difference may be, for example, up to 0.75 inches or up to 1.5 inches. However, other values for the difference between the second distance and the first distance may be possible, depending on such factors as the tensile strength of the materials used to construct the container, the coefficients of friction between the portions of the cap and the portions of the body that make contact, and the size and weight of the intended contents of the container, among other factors. Any difference may be appropriate to facilitate placing the cap into the closed position with the body.

The inner wall 440 may extend in a single continuous arc between the floor 434 of the channel and the opening 438 of the channel or the upper inner rim 444 of the channel. The one or more first friction sealer(s) 426 may make contact with, but not protrude through, the respective surface area of the inner wall. Upon contact with the inner wall the one or more first friction sealer(s) may flex, thereby creating a friction fit or seal which may be substantially impermeable to gases and liquids.

The outer wall 442 may extend in a single continuous arc between the floor 434 of the channel and the opening 438 of the channel or the upper outer rim 446 of the channel. The one or more second friction sealer(s) 430 may make contact with, but not protrude through, the respective surface area of the outer wall. Upon contact with the outer wall the one or more second friction sealer(s) may flex, thereby creating a friction fit or seal which may be substantially impermeable to gases and liquids.

Example 6

Figure 17:
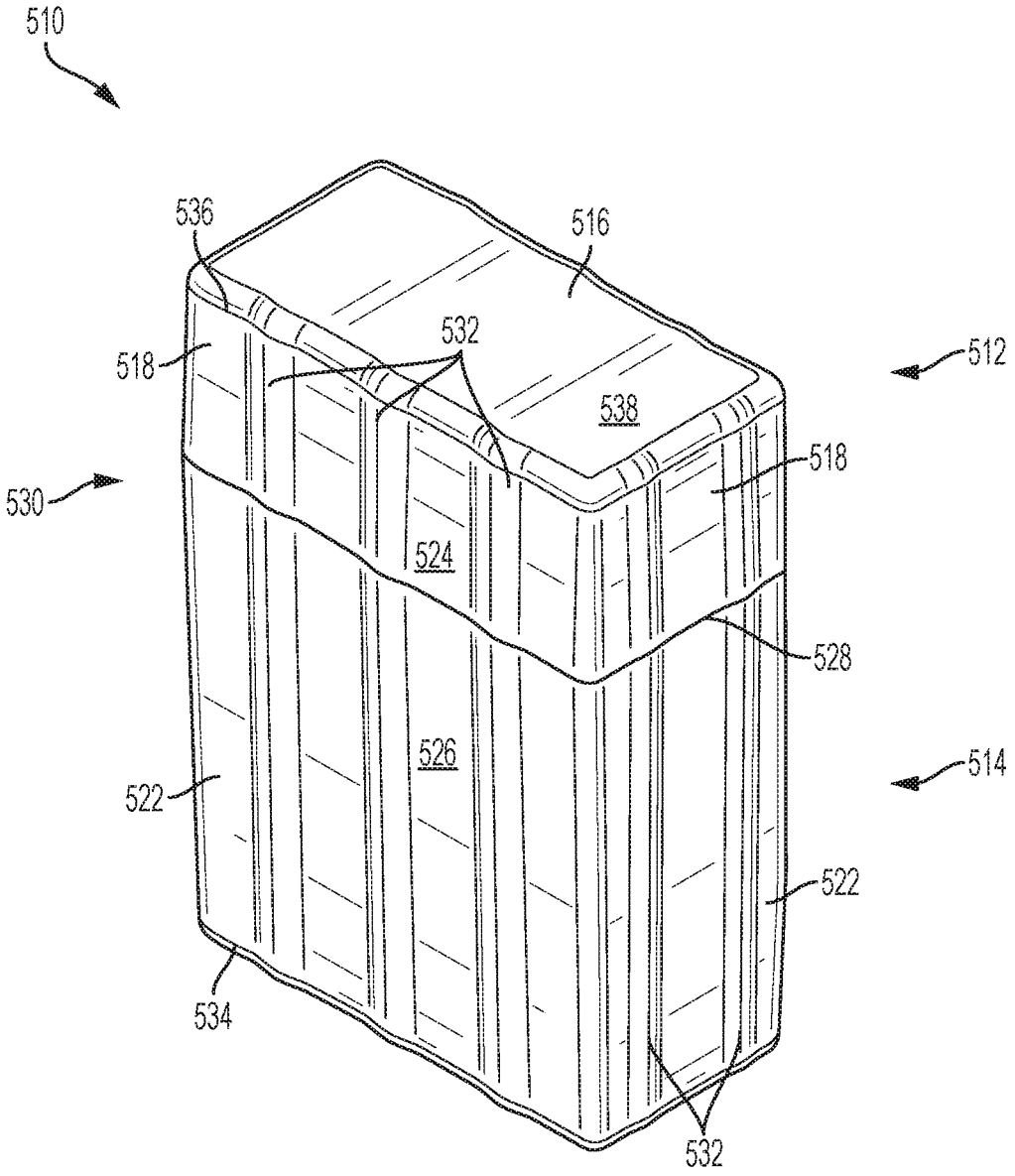
FIG. 17 shows a perspective view of another embodiment of a container with the cap and body in a closed position showing an exterior grip structure.
Figure 18:
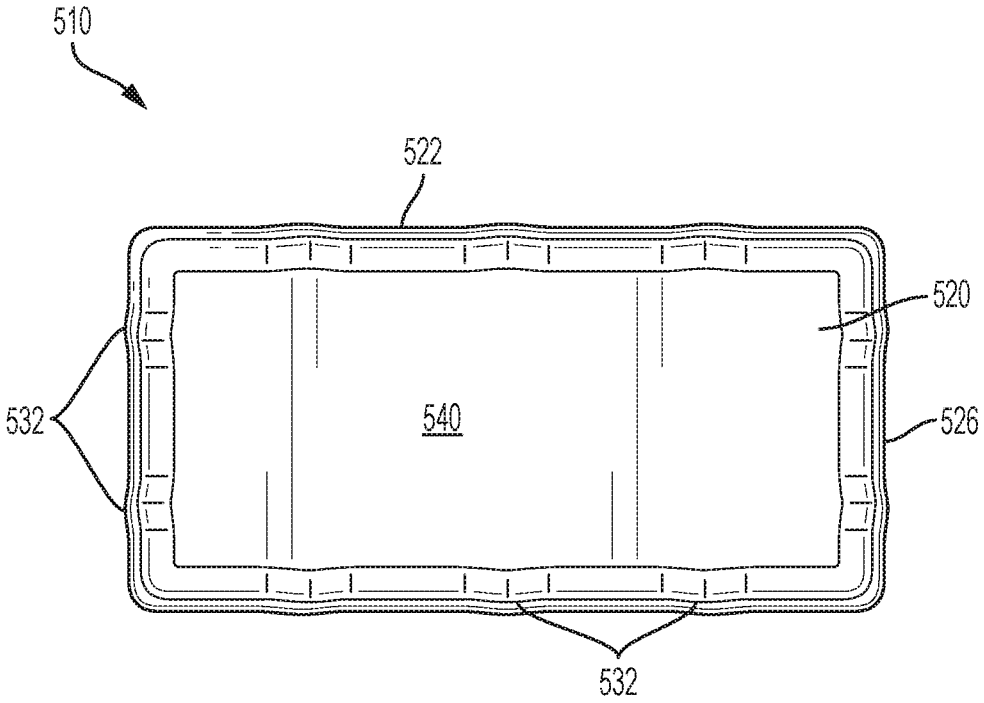
FIG. 18 shows a bottom view of the embodiment of the container of FIG. 17.

This example describes another illustrative embodiment of a container, see FIGS. 17-18.

FIG. 17 shows a perspective view of another embodiment of a container, generally indicated at 510, showing container 510 in a closed position. Container 510 may include a cap 512 which is an embodiment of cap 312 and a body 514 which is an embodiment of body 314 as described in Example 4. Container 510 may be configured to hold tobacco products and lighting material, or any other appropriate items.

Cap 512 may include a top 516 and cap walls 518 extending from the top. Body 514 may have a bottom 520, best seen in FIG. 18, and body walls 522 extending from the bottom. The cap walls 518 may have an exterior surface 524 and the body walls 522 may have an exterior surface 526. The exterior surface 524 of the cap walls may meet the exterior surface 526 of the body walls along a junction 528. Together, the exterior surfaces 524 and 526 of the cap and body walls may form an exterior container surface 530 when the container is in the closed position.

The exterior surface 526 of the body walls 522 and the exterior surface 524 of the cap walls 518 may have grip structure 532. Grip structure 532 may include a set of spaced apart aretes than may run continuously and longitudinally along the exterior surfaces 526 and 524 of the body and cap walls. The aretes of grip structure 532 may alternately be referred to as ridges, spines, ribs, or elevations, etc. The grip structures may include a discrete set of aretes, such as one, two, three, or more than three aretes disposed on any given side of container 510.

The grip structures may run longitudinally, for example, from proximal ends 534 of the body walls proximate the bottom of the container to proximal ends 536 of the cap walls proximate the top 516 of the container. The grip structures may run continuously, that is there may be substantially no change in the shape or elevation of the grip structures along the exterior container surface 530, even across the junction 528 between cap and body walls. Thus, the cap 512 and the body 514 may form a flush fit when in the closed position.

The grip structures 532 may not extend to a top surface 538 of the top 516 of container 510. Top surface 538 may be smooth or textured.

FIG. 18 shows a bottom view of container 510. The grip structures 532 disposed on the exterior surface 526 of the body walls 522 may not extend to a bottom surface 540 of the bottom 520 of the container. Bottom surface 540 may be smooth or textured.

Example 7

Figure 19:
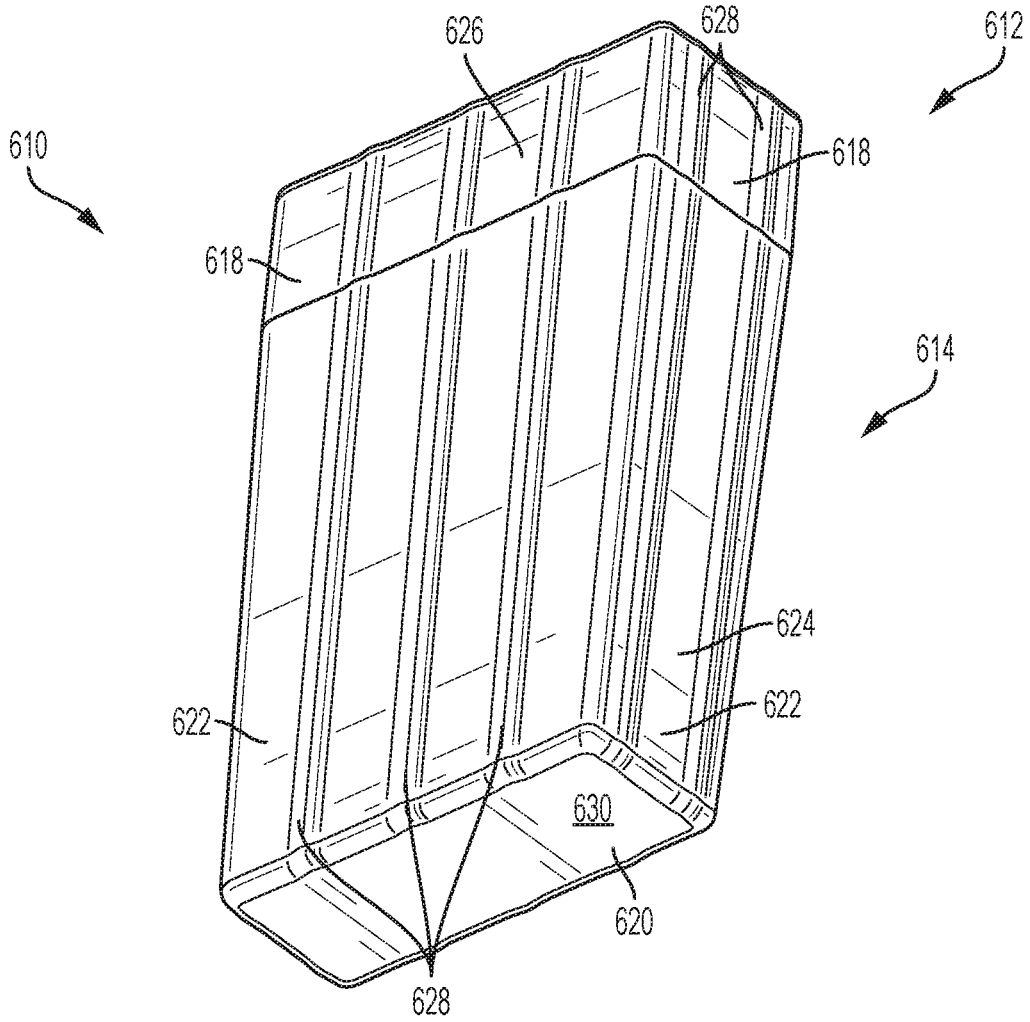
FIG. 19 shows a perspective view of another embodiment of a container with the cap and body in a closed position showing an exterior grip structure.
Figure 20:
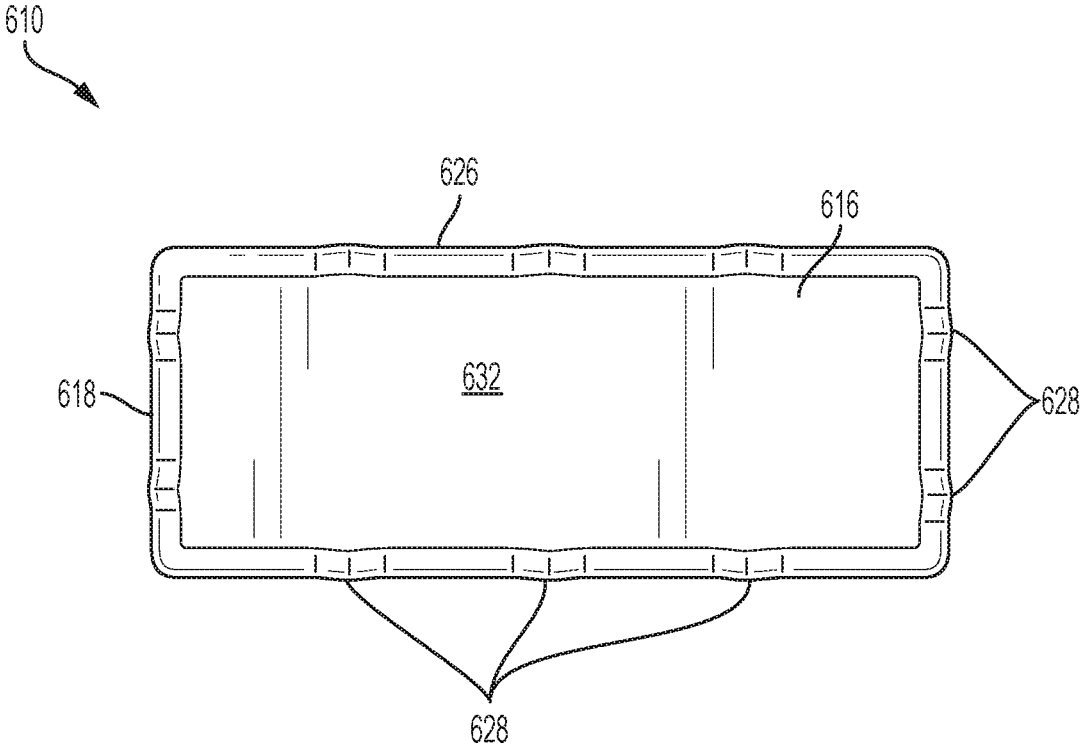
FIG. 20 shows a top view of the embodiment of the container of FIG. 19.

This example describes another illustrative embodiment of a container, see FIGS. 19-20.

FIG. 19 shows a perspective view of another embodiment of a container, generally indicated at 610, showing container 610 in a closed position. Container 610 may include a cap 612 which is an embodiment of cap 312 and a body 614 which is an embodiment of body 314 as described in Example 4. Container 610 may be configured to hold one or more rounds of ammunition, or any other appropriate items.

Cap 612 may include a top 616, best seen in FIG. 20, and cap walls 618 extending from the top. Body 614 may include a bottom 620 and body walls 622 extending from the bottom. An exterior surface 624 of the body walls and an exterior surface 626 of the cap walls may have a grip structure 628. Grip structure 628 may be similar to grip structure 532 described in Example 6, except where dimensions of grip structure 628 may be sized according to container 610 and dimensions of grip structure 532 may be sized according to container 510. Grip structure 628 may include a set of spaced apart aretes that run continuously and longitudinally along the exterior surfaces 624 and 626 of the body and cap walls. Grip structure 628 may not extend to a bottom surface 630 of the bottom 620 of the body. Bottom surface 630 may be smooth or textured.

FIG. 20 shows a top view of container 610. The grip structures 628 disposed on the exterior surface 626 of the cap walls 618 may not extend to a top surface 632 of the top 616 of the container. Top surface 632 may be smooth or textured.

Example 8

Figure 21:
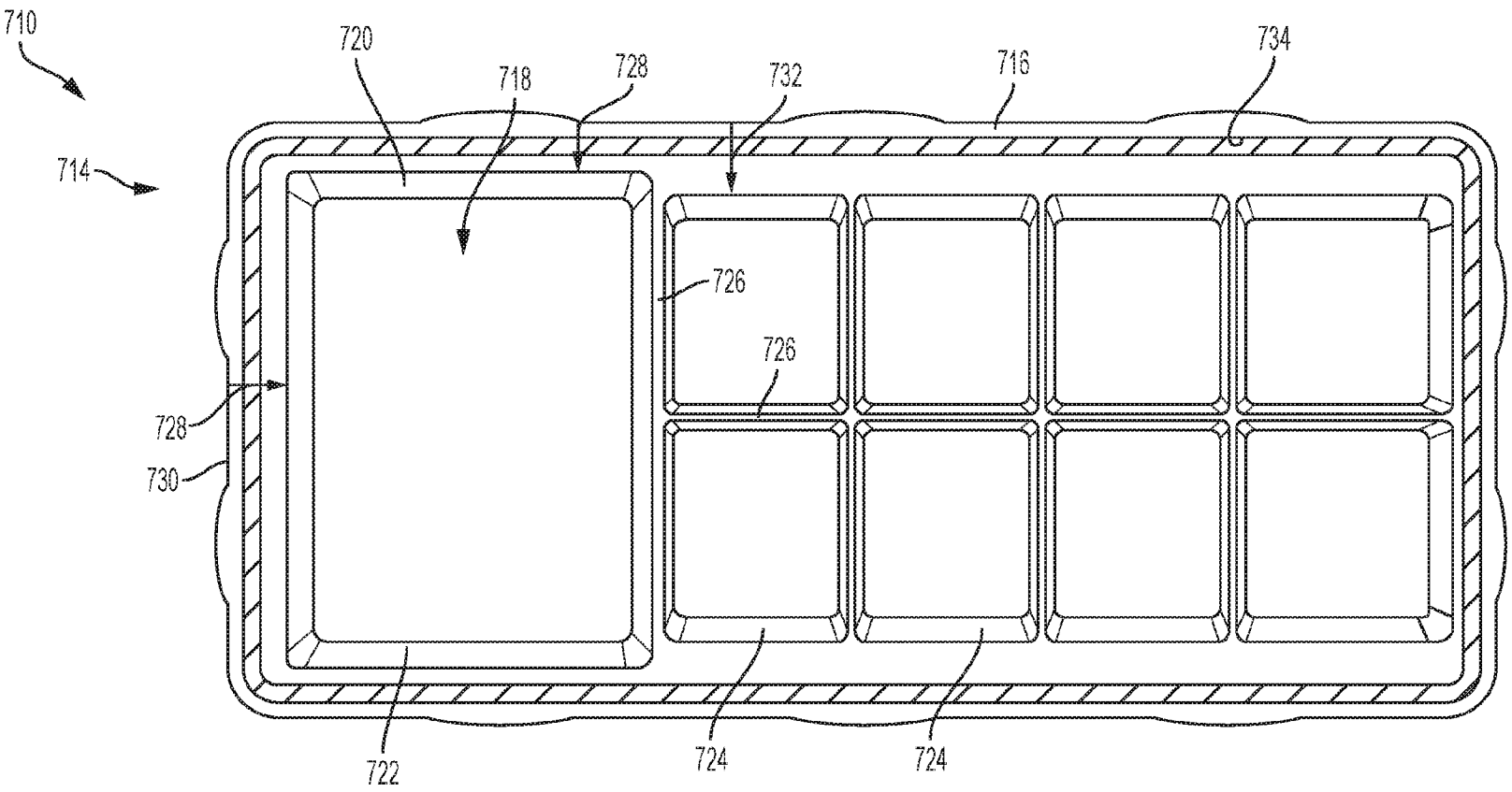
FIG. 21 shows a top view of another embodiment of a body of a container, showing body walls with variable thickness.

This example describes another illustrative embodiment of a container, see FIG. 21.

FIG. 21 shows a top view of another embodiment of a body of a container, generally indicated at 710. Container 710 may include a cap not shown in FIG. 21. The cap of container 710 may be an embodiment of cap 312, or similar to the embodiments of cap 412, or cap 512 described herein. Container 710 may include a body 714 which may be an embodiment of body 314, or similar to the embodiments of body 414, or body 514 described herein. FIG. 21 shows a top view of the body of container 710.

Body 714 may have body walls 716 which may form a cavity 718 on an inner side 720. Cavity 718 may have one or more compartments, for example a first compartment 722 and one or more second compartments 724. The first compartment 722 may be configured to hold ignition material(s) such as a lighter, matches, a book of matches, or a box of matches. The one or more second compartments 724 may be configured to hold tobacco product(s), such as cigarettes. The one or more compartments may be separated by internal dividers 726.

The body walls 716 may have a first thickness 728 between the first compartment 722 and an exterior surface 730 of the body walls. The body walls may have a second thickness 732 between a second compartment 724 and the exterior surface 730 of the body. The second thickness 732 may be different from the first thickness, for example, the second thickness may be greater than the first thickness.

In the case where the second thickness 732 is greater than the first thickness 728, having thicker body walls 716 proximate the one or more second compartments 724 may make the one or more second compartments correspondingly more narrow. In the case where the one or more second compartments are configured to hold cigarettes, narrow compartments may hold the cigarettes in an upright position such that upper ends of the cigarettes are held a distance away from a channel 734 disposed within the body walls, where channel 734 may be sized to receive a portion of the cap when container 710 is in the closed position. Having the upper ends of the cigarettes separated from the channel by thicker body walls may facilitate closing of the container.

Example 9

Figure 22:
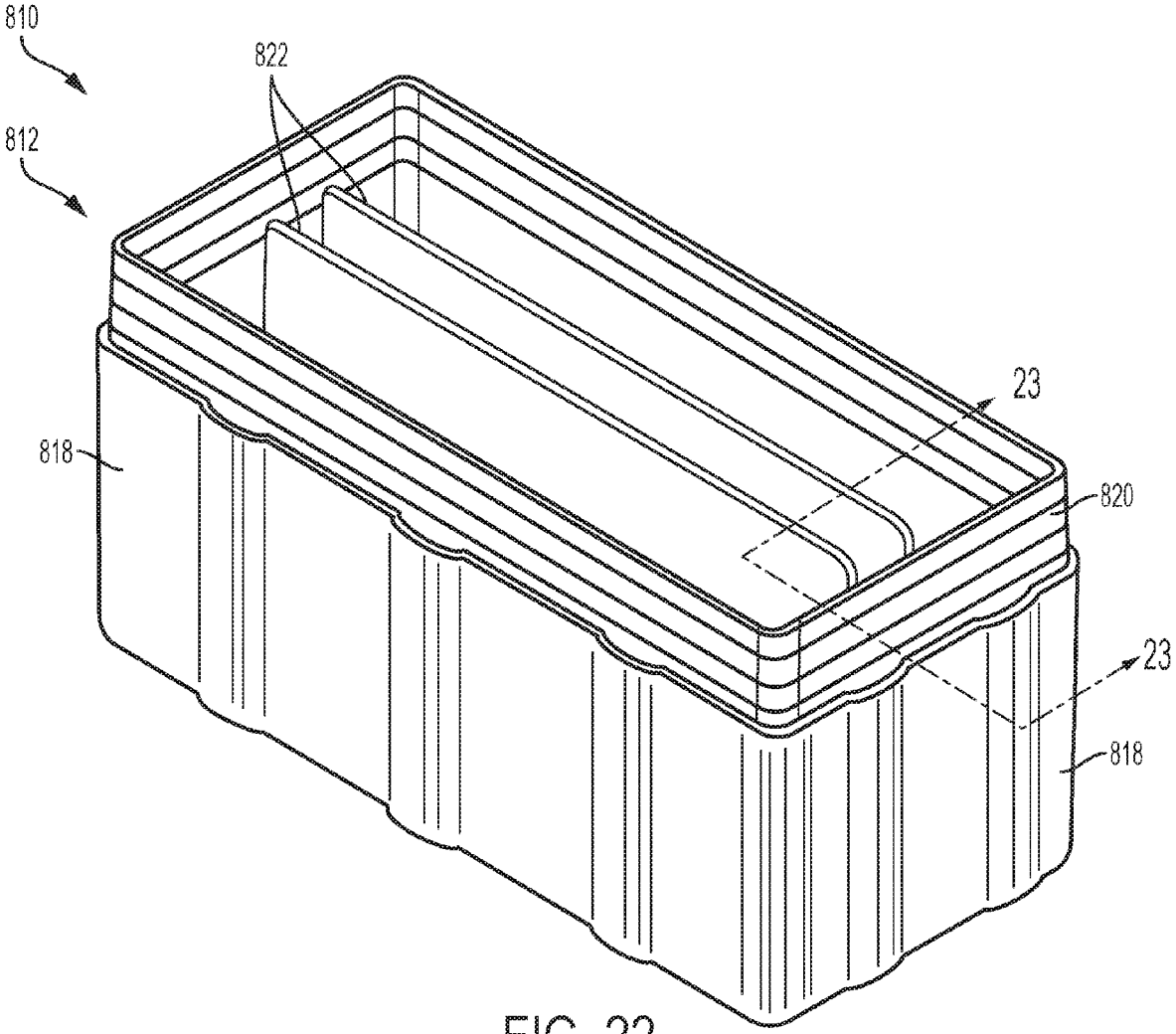
FIG. 22 shows a perspective view of another embodiment of a cap of a container, showing one or more cap underprotrusions.
Figure 23:
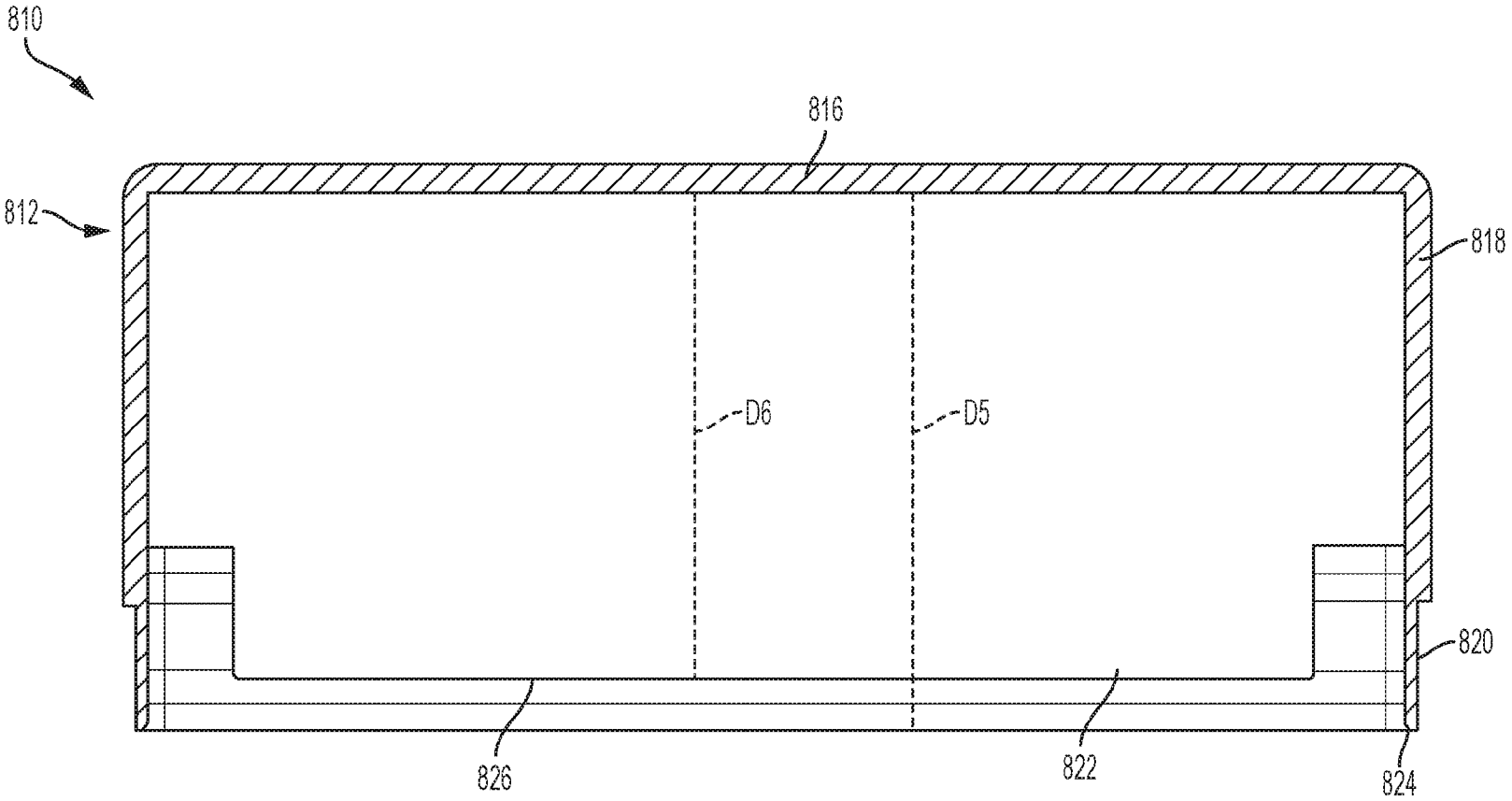
FIG. 23 shows a cross-sectional view, taken along plane 23-23 in FIG. 22, of the embodiment of the cap of FIG. 22.
Figure 24:
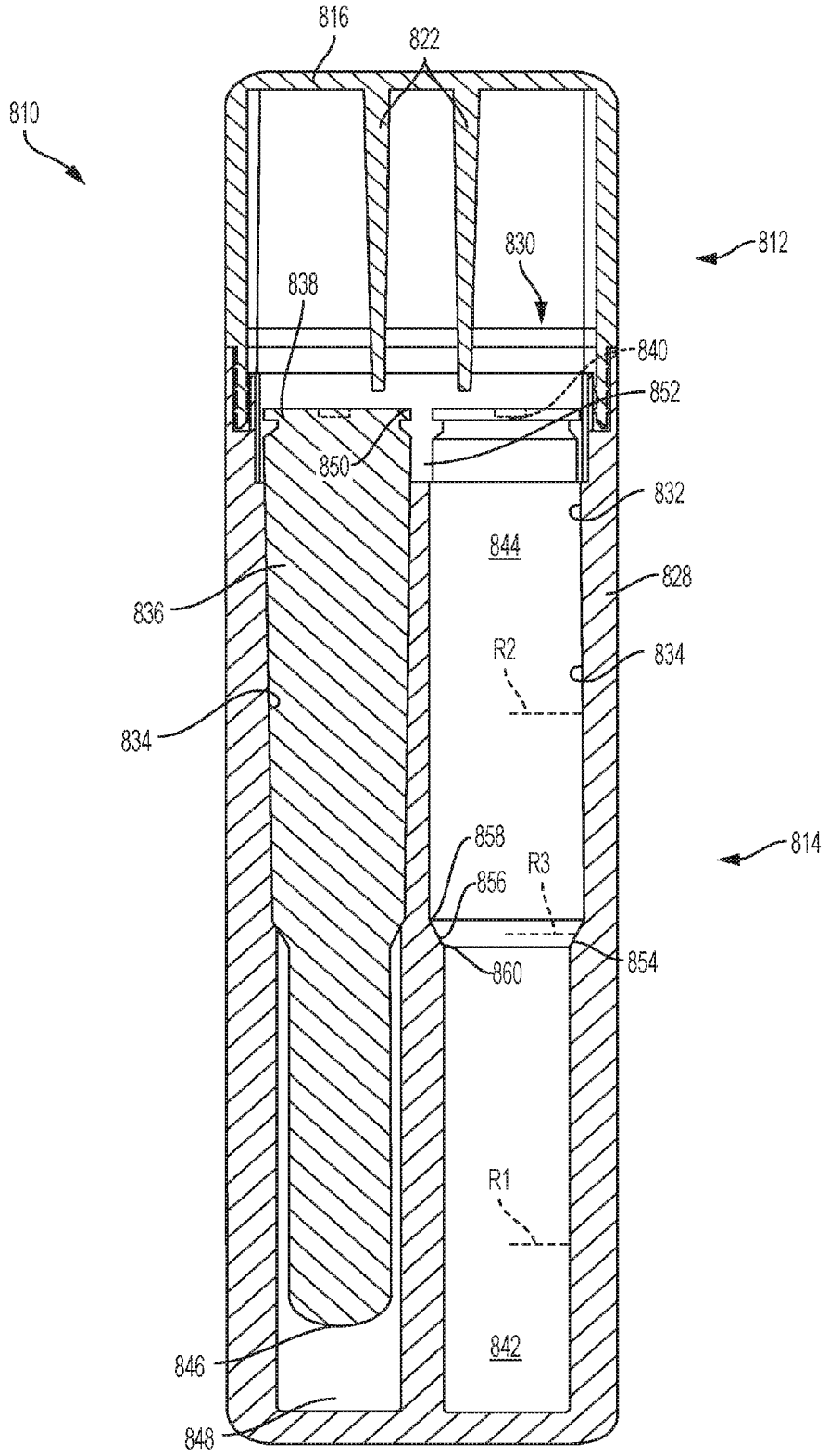
FIG. 24 shows a cross-sectional view of the embodiment of the container of FIG. 22 in a closed position.

This example describes another illustrative embodiment of a container, see FIGS. 22-24.

FIG. 22 shows a perspective view of another embodiment of a container, the container generally indicated at 810. Container 810 may include a cap 812 which may be an embodiment of cap 312, or similar to the embodiments of cap 412, and cap 612 described herein. Container 810 may include a body 814, best seen in FIG. 24, which may be an embodiment of body 314, or similar to the embodiments of 414, and 614 described herein.

Cap 812 may include a top 816, cap walls 818, a protruding end 820, and cap under-protrusions 822. Top 816 may be best seen in FIGS. 23 and 24. The cap walls 818 may extend from the top and the protruding end 820 may extend from the cap walls in an opposite direction from the top. The cap under-protrusions 822 may extend from the top and may be interior to the cap walls. Cap under-protrusions 822 may be one or more elongate fins, ridges, or bars, or may be one or more posts.

FIG. 23 shows a cross-sectional view, taken along plane 23-23 in FIG. 22, of the cap 812. Cap under-protrusion 822 may extend from the top 816 of cap 812 and/or the cap walls 818. Protruding end 820 may have a remote end 824 distal from the top of the cap. The remote end 824 of the protruding end may be disposed a third distance D5 from the top of the cap. Cap under-protrusion 822 may have a remote end 826 distal from the top of the cap. The remote end 826 of the cap under-protrusion may be disposed a fourth distance D6 from the top of the cap. Fourth distance D6 may be different from third distance D5, relative to the top of the cap. Fourth distance D6 may be smaller than third distance D5.

FIG. 24 shows a cross-sectional view of container 810 in a closed position. FIG. 24 is similar to the cross-sectional view in FIG. 12 but taken in a plane that is perpendicular to the plane taken in FIG. 12. Cap under-protrusions 822 may extend from the top 816 toward the body 814 when in the closed position. Body 814 may include body walls 828 which may form a cavity 830 on an inner side 832. Cavity 830 may be divided into one or more internal compartments 834.

If the internal compartments 834 of container 810 are configured to hold one or more rounds of ammunition 836, then cap under-protrusions 822 may help to keep those rounds of ammunition in place regardless of the orientation of container 810. In some embodiments, such as that of FIG. 24, should the container be turned upside down and the rounds of ammunition move in a direction towards the top 816 of the cap 812, the cap under-protrusions 822 may contact the rounds of ammunition at a place other than the center of the end of the round. That is, the cap under-protrusions may be positioned in a manner to make contact with the rounds of ammunition on a casing 838 of the round but not with a primer 840 at the center of the casing, thus keeping the rounds stabilized in their respective compartments. In some embodiments the cap under-protrusions may contact the round of ammunition at any other point in order to prevent the round from moving in a direction towards top 816 of the cap. The portion of the cap under-protrusions that makes contact with the round of ammunition may be rounded off and/or radiused.

Compartments 834 may be similar to compartments 234 of container 210 described herein. Each compartment 834 may have a bottom chamber wall portion 842 of a first radius R1 and a top chamber portion 844 of a second radius R2. The second radius may be larger than the first radius. The top and bottom chamber wall portions may be adapted to hold the round of ammunition 836 in a suspended position. Thus held, a projectile end 846 of the round of ammunition may extend downward in the bottom chamber wall portion 842 so that the projectile end extends into a lower space 848 and is free of contact with any portion of container 810.

Cavity 830 may be configured such that an upper rim 850 of casing 838 of the round of ammunition 836 may extend above the top chamber wall portion 844 into an upper open space 852 above the respective compartment 834 when the round of ammunition is received within the respective compartment. This configuration may facilitate the removal of the round of ammunition from the container.

Each compartment 834 may include a transition wall area 854 between the top chamber wall portion 844 and the bottom chamber wall portion 842. The transition wall portion may have a third radius R3 that is larger than the first radius R1 and smaller than the second radius R2. The transition wall portion may have a flat angled wall portion 856, a first rounded edge 858 between the top chamber wall portion and the flat angled wall portion, and a second rounded edge 860 between the flat angled wall portion and the bottom chamber wall portion.

Example 10

Described above are several exemplary embodiments of containers, namely containers 10, 110, 210, 310, 410, 510, 610, 710, and 810. Each of these embodiments is shown in the drawings and described with various exemplary features. However, many more embodiments are possible and within the scope of this disclosure. This Example provides a description of several more possible embodiments combining certain features of the specific embodiments already described. The alternative embodiments described are not to be taken as a complete list as other combinations are also possible.

At least two channels have been described for receiving a portion of the cap of a container, for example channel 20 described in Example 1 and channel 346 described in Example 4. These channels may differ in the relative disposition of the upper inner rim and the upper outer rim. Either of these two channels may be combined with any of the embodiments described herein.

Several embodiments of caps have been described herein. For example, cap 412 is shown in FIG. 15 as having cap inside chamfer 422 proximate the remote end 420 of the protruding end 416 of the cap 412. Further, cap 112 is shown in FIG. 5 with the protruding end 116 of cap 112 not including a cap inside chamfer. As will be appreciated, a cap inside chamfer such as cap inside chamfer 422 may be included with any of the embodiments of caps described herein.

At least two configurations for an exterior surface of a container have been described. For example in FIG. 3 the exterior surface 150 of container 110 depicted as shown free of any elevated grip structure and in FIG. 17 the exterior surface 530 of container 510 is shown with external grip structures 532. The exterior surface of any of the embodiments described herein may include or not include external grip structures such as grip structures 532.

Several configurations of body walls have been described herein. For example, body 714 of container 710 is depicted in FIG. 21 as having variable thickness body walls 716. That is, the body walls may have a first thickness 728 in a first portion of the body walls between the first compartment 722 and the exterior surface 730 of the body, and a second thickness 732 in a second portion of the body walls between the second compartments 724 and the exterior surface of the body. In another example, body 114 of container 110 is depicted in FIG. 6 of having more constant thickness body walls. Any of the embodiments described herein may include either of variable thickness body walls or constant thickness body walls.

Several configurations of a cap have been described herein. In particular, cap 812 of container 810 is depicted in FIG. 22-24 as having one or more cap under-protrusions 822. These cap under-protrusions may help stabilized rounds of ammunition held within container 810. Such cap under-protrusions may be combined with any of the embodiments described herein. In particular, such cap under-protrusions may be included with containers 10, 210, 310, 410, and 610, which may be configured to hold one or more rounds of ammunition. In addition, such cap under-protrusions may be included with containers 110, 510, and 710 as the under-protrusions may help stabilize whatever materials are held within the containers.

CONCLUSION

While embodiments of one or more containers have been particularly shown and described, many variations may be made therein. This disclosure may include one or more independent or interdependent embodiments directed to various combinations of features, functions, elements and/or properties. Other combinations and sub-combinations of features, functions, elements and/or properties may be claimed later in a related application. Such variations, whether they are directed to different combinations or directed to the same combinations, whether different, broader, narrower or equal in scope, are also regarded as included within the subject matter of the present disclosure. Accordingly, the foregoing embodiments are illustrative, and no single feature or element, or combination thereof, is essential to all possible combinations that may be claimed in this or a later application.

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. Each example defines an embodiment disclosed in the foregoing disclosure, but any one example does not necessarily encompass all features or combinations that may be eventually claimed. Where the description recites "a" or "a first" element or the equivalent thereof, such description includes one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

What is claimed is:

1. A container comprising:

a cap and a body;

the body including a bottom and body walls extending from the bottom from proximal ends of the body walls to distal ends of the body walls;

the body walls having a channel disposed within the body walls and proximate the distal ends of the body walls, the channel having a floor, an opening proximate the distal ends of the body walls, an inner wall including an upper inner rim disposed a first distance from the bottom of the body, and an outer wall including an upper outer rim disposed a second distance from the bottom of the body, the second distance greater than the first distance relative to the bottom of the body, wherein the channel is sized to receive a portion of the cap when the container is in a closed position, further wherein the inner wall defines a continuous plane through which the proximal end of the body walls and a distal end of the upper inner rim extend, further wherein no portion of the channel breaks the continuous plane.

2. The container of claim 1, wherein the cap includes a top and cap walls extending from the top, and wherein an exterior surface of the body walls and an exterior surface of the cap walls have a grip structure including a set of spaced apart aretes that run continuously and longitudinally along the exterior surfaces of the body and cap walls.

3. The container of claim 1, wherein the cap includes a top, cap walls, and a protruding end, the cap walls extending from the top, the protruding end extending from the cap walls in an opposite direction from the top to a remote end of the protruding end, the protruding end having a cap inside chamfer proximate an inner lip of the remote end of the protruding end, the protruding end being the portion of the cap received within the channel.

4. The container of claim 3, wherein an exterior surface of the body walls and an exterior surface of the cap walls have a grip structure including a set of spaced apart aretes that run continuously and longitudinally along the exterior surfaces of the body and cap walls.

5. The container of claim 4, wherein the cap includes one or more cap under-protrusions interior to the cap walls and extending from the top toward the body when in the closed position.

6. The container of claim 5, wherein each of the inner and outer walls extends in a single continuous arc between the floor of the channel and the opening of the channel.

7. The container of claim 4, wherein the body walls form a cavity on an inner side and the cavity has one or more compartments, and wherein the body walls have a first thickness between a first compartment and an exterior surface of the body and a second thickness between a second compartment and the exterior surface of the body, the second thickness different from the first thickness.

8. The container of claim 1, wherein the cap includes a top and cap walls extending from the top, and wherein the cap includes one or more cap under-protrusions interior to the cap walls and extending from the top toward the body when in the closed position.

9. The container of claim 8, wherein the body walls form a cavity on an inner side and the cavity has one or more compartments, each compartment having a bottom chamber wall portion of a first radius, and a top chamber wall portion of a second radius larger than the first radius, wherein the top and bottom chamber wall portions are adapted to hold a round of ammunition in a suspended position, such that a projectile end of the round of ammunition extends downward in the bottom chamber wall portion so that the projectile end extends into a lower open space and is free of contact with any portion of the container.

10. The container of claim 9, wherein the cavity is configured such that an upper rim of a casing of a round of ammunition extends above the top chamber wall portion into an upper open space above the respective compartment when the round of ammunition is received within the respective compartment.

11. The container of claim 9, wherein each compartment includes a transition wall area between the top chamber wall portion and the bottom chamber wall portion, the transition wall portion having a third radius that is larger than the first radius and smaller than the second radius.

12. The container of claim 11, wherein the transition wall portion has a flat angled wall portion, a first rounded edge between the top chamber wall portion and the flat angled wall portion, and a second rounded edge between the flat angled wall portion and the bottom chamber wall portion.

13. The container of claim 8, wherein the cap includes a protruding end extending from the cap walls in an opposite direction from the top and one or more first friction sealer(s) disposed on and protruding from a first side of the protruding end, further wherein the one or more first friction sealer(s) are one or more first flexible rib(s) that flex to form a friction seal within the channel when the container is in the closed position.

14. The container of claim 13, wherein the cap includes one or more second friction sealer(s) disposed on and protruding from a second side of the protruding end that is opposite the first side, further wherein the one or more second friction sealer(s) are one or more second flexible rib(s) that flex to form a friction seal within the channel when the container is in the closed position, and further wherein the one or more first friction sealer(s) and the one or more second friction sealer(s) make contact with, but do not protrude through, respective surface areas of the inner and outer walls of the channel.

15. The container of claim 1, wherein the body walls form a cavity on an inner side and the cavity has one or more compartments, and wherein the body walls have a first thickness between a first compartment and an exterior surface of the body and a second thickness between a second compartment and the exterior surface of the body, the second thickness different from the first thickness.

16. The container of claim 15, wherein the cap includes a protruding end extending from the cap walls in an opposite direction from the top and one or more first friction sealer(s) disposed on a first side of the protruding end.

17. A container comprising:

a cap and a body;

the body including a bottom and body walls extending from the bottom from proximal ends of the body walls to distal ends of the body walls;

the body walls having a channel disposed within the body walls and proximate the distal ends of the body walls, the channel having a floor, an opening proximate the distal ends of the body walls, an inner wall including an upper inner rim disposed a first distance from the bottom of the body, and an outer wall including an upper outer rim disposed a second distance from the bottom of the body, the second distance greater than the first distance relative to the bottom of the body, wherein a continuous horizontal plane is defined by a distal end of the upper inner rim, and the body walls form a container cavity on an inner side of the body between the continuous horizontal plane and the bottom, further wherein, when the container is in a closed position, the channel is sized to receive a protruding end of the cap and no portion of the protruding end of the cap breaks the continuous horizontal plane into the container cavity.

18. The container of claim 17, further wherein the cap includes a top, a first cap wall opposite a second cap wall, a third cap wall opposite a fourth cap wall, with each of the first, second, third and fourth cap walls extending from the top, and a first cap under-protrusion disposed on the top interior to the first, second, third and fourth cap walls, the first cap under-protrusion extending from a first end proximate the first cap wall to a second end proximate the second cap wall, further wherein, in the closed position, a first portion of the first cap under-protrusion extends above a first chamber of the container, and a second portion of the first cap under-protrusion extends above a second chamber of the container.

19. The container of claim 18, further wherein the cap includes a second cap under-protrusion extending along the top in a parallel position adjacent to the first cap under-protrusion.

20. A container comprising:

a cap and a body;

the body including a bottom and body walls extending from the bottom from proximal ends of the body walls to distal ends of the body walls;

the body walls having a channel disposed within the body walls and proximate the distal ends of the body walls, the channel having a floor, an opening proximate the distal ends of the body walls, an inner wall including an upper inner rim disposed a first distance from the bottom of the body, and an outer wall including an upper outer rim disposed a second distance from the bottom of the body, the second distance greater than the first distance relative to the bottom of the body, wherein the channel is sized to receive a portion of the cap when the container is in a closed position wherein each of the inner and outer walls extends in a single continuous arc between the floor of the channel and the opening of the channel.

* * * * *